US009239149B2

(12) United States Patent
Vice et al.

(10) Patent No.: US 9,239,149 B2
(45) Date of Patent: Jan. 19, 2016

(54) RECESSED LUMINAIRE

(71) Applicant: Focal Point, L.L.C., Chicago, IL (US)

(72) Inventors: Edwin Vice, Chicago, IL (US); David E. Doubek, LaGrange, IL (US); Casey Chung, Bloomingdale, IL (US)

(73) Assignee: Focal Point, LLC, Chicago, IL (US)

( * ) Notice: Subject to any disclaimer, the term of this patent is extended or adjusted under 35 U.S.C. 154(b) by 78 days.

(21) Appl. No.: 14/263,638

(22) Filed: Apr. 28, 2014

(65) Prior Publication Data

US 2015/0308662 A1 Oct. 29, 2015

(51) Int. Cl.

| | |
|---|---|
| ***F21V 17/02*** | (2006.01) |
| ***F21V 21/00*** | (2006.01) |
| ***F21V 14/02*** | (2006.01) |
| ***F21S 8/02*** | (2006.01) |
| ***F21V 14/08*** | (2006.01) |
| ***F21V 21/04*** | (2006.01) |

(52) U.S. Cl.

CPC . *F21V 14/02* (2013.01); *F21S 8/02* (2013.01); *F21V 14/08* (2013.01); *F21V 21/04* (2013.01)

(58) Field of Classification Search

CPC ..... F21S 8/02; F21V 14/02; F21V 14/08; F21V 21/04

See application file for complete search history.

(56) References Cited

U.S. PATENT DOCUMENTS

| | | | | |
|---|---|---|---|---|
| 7,186,008 | B2 * | 3/2007 | Patti | F21S 8/02 362/147 |
| 7,748,868 | B2 * | 7/2010 | Patti | F21S 8/02 362/147 |

* cited by examiner

*Primary Examiner* — Stephen F Husar

(74) *Attorney, Agent, or Firm* — Banner & Witcoff, Ltd.

(57) ABSTRACT

A recessed luminaire is described. The luminaire may include an aiming system allowing a rotation angle and/or a tilt angle of a light source to be adjusted while the light source is in operation. Additionally, the luminaire includes a light shield that is coupled to the aiming system such that the light shield may move in relation to the tilt angle and the orientation of the light source. The aiming system may be further coupled to a support panel such that rotation of the aiming system is provided by a rotatable coupling between one or more leaf Springs of the aiming system, and an upper surface of the support panel.

26 Claims, 19 Drawing Sheets

RECESSED LUMINAIRE

FIELD OF THE INVENTION

The present invention relates to the field of luminaires, more particularly to the field of luminaires that may be installed in a recessed manner.

BACKGROUND

Light fixtures or luminaires are commonly used in a variety of commercial and residential settings. While many types of luminaires exist, one popular type is a recessed luminaire. One advantage of a recessed luminaire, depending on the design, is that the majority of the structure of the luminaire may be mounted in the ceiling or wall so that it does not noticeably extend beyond the mounting surface, thereby providing an appearance with limited visibility of constituent components when the luminaire is installed.

A luminaire being installed in a ceiling is typically installed by first mounting a housing, or support panel, to a one or more ceiling supports so that the housing is aligned with the planned surface of the ceiling. This alignment process can be difficult as the actual surface is not there when the housing is being aligned. Next a surface material, which may be drywall, drop ceiling tiles or any other suitable surface material, is installed after the housing of the luminaire is installed. To allow the luminaire to function, a hole is provided in the surface. Often a trim plate with a flange is attached to the housing so as to cover up an edge of the hole, as well as internal components of the luminaire.

Upon installation of a luminaire, one or more adjustments me be made to an orientation and/or angle of a constituent light source. Current luminaires make it difficult to aim the light source (otherwise referred to as a bulb or lamp) while the luminaire is on; as such, adjusting the aim often requires turning the power off, partially disassembling the luminaire, making an adjustment in the light source aiming assembly, reassembling the luminaire and then turning the power back on to see if the adjustment correctly aimed the light source in the desired direction. This process is made more troublesome if one or more lens and/or filters are used to shape the light emitted from the light source because often the lens and/or filters need to be carefully orientated. As a consequence, such an aiming process may be tedious, time consuming, and expensive; however, the ability to adjust one or more of an orientation and/or an angle of a light source of a luminaire allows said luminaire to provide a variety of lighting effects in addition to down lighting, such as accent or wall-wash lighting.

Therefore, a need exists for improvements in luminaire design, including improvements in one or more mechanisms for aiming a light source associated with the luminaire.

BRIEF SUMMARY

The following presents a simplified summary of the present disclosure in order to provide a basic understanding of some aspects of the claimed subject matter. This summary is not an extensive overview of the claimed subject matter. It is not intended to identify key or critical elements of the claimed subject matter or to delineate the scope of the claimed subject matter. The following summary merely presents some concepts of the claimed subject matter in a simplified form as a prelude to a more detailed description provided below.

Aspects of the systems and methods described herein relate to a luminaire. The luminaire may be used with a light source, and have a support panel supporting an aiming system that is configured to aim the light source. The luminaire may further comprise a tilt linkage four adjustment of an orientation of the aiming system, wherein the tilt linkage may have a light source support structure and the linear actuator for actuation of the linkage. A bracket structure may connect the linear actuator to the light source support structure such that linear motion of the actuator may be converted into a rotational motion of the support structure.

In another aspect, this disclosure includes a system for controlling an orientation of a light source in a luminaire. The system may include an aiming system that may be rotated and/or tilted. Further, the system may include a tilt linkage for converting linear motion of a linear actuator into a rotational motion of a light source.

In yet another aspect, the systems and methods described herein relate to a recessed luminaire having a support panel supporting an aiming system for aiming a light source, the aiming system having a tilt mechanism and a rotation mechanism. The recessed luminaire may further have a trim plate that may be partially disassembled from the luminaire for adjustment of a rotation or a tilt of the light source.

BRIEF DESCRIPTION OF THE DRAWINGS

The present invention is illustrated by way of example and not limited in the accompanying figures in which like reference numerals indicate similar elements and in which.

DETAILED DESCRIPTION OF THE INVENTION

As discussed above, there is need for improved luminaire designs. Furthermore, as is apparent from the Figures described above and the description provided below, various components are disclosed below, wherein said components may be mounted to other components. Mounting may be direct or indirect and this disclosure is not intended to be limiting in this respect. It is noted that various component are described below as separate components. Two or more of these components may be combined to form a single component as appropriate, and this disclosure is not intended to be limiting in this respect.

In addition, various features are described below in greater detail. It should be noted that different combinations of these features may be combined as desired to generate luminaires with more or less features, depending on the features that are needed. Thus, it is envisioned that additional luminaires using combinations of the below described features are within the scope of the present invention.

In one implementation, the systems and methods described herein are directed towards one or more embodiments of a luminaire having one or more mechanisms for aiming a light source/a fixture of the luminaire while in operation (hot aiming or the feature of being hot aimable). While hot aiming is a useful feature in and of itself, additional benefits can be gained if there is a separate rotation adjustment and angular orientation adjustment. Such a configuration may allow an installer to quickly adjust a rotational orientation or in angular orientation, and without concern that they are adjusting the other. In another embodiment, the systems and methods described herein may allow for simultaneous adjustment of both angular and rotational orientation, which, in one implementation, may allow for *facile* aiming of the luminaire. For example, the effect of a grid pattern may be more carefully aimed by simultaneously adjusting the angular and rotational orientation of the light source. Other potential benefits will become clear after a further review of the disclosure provided below.

Figure 1:
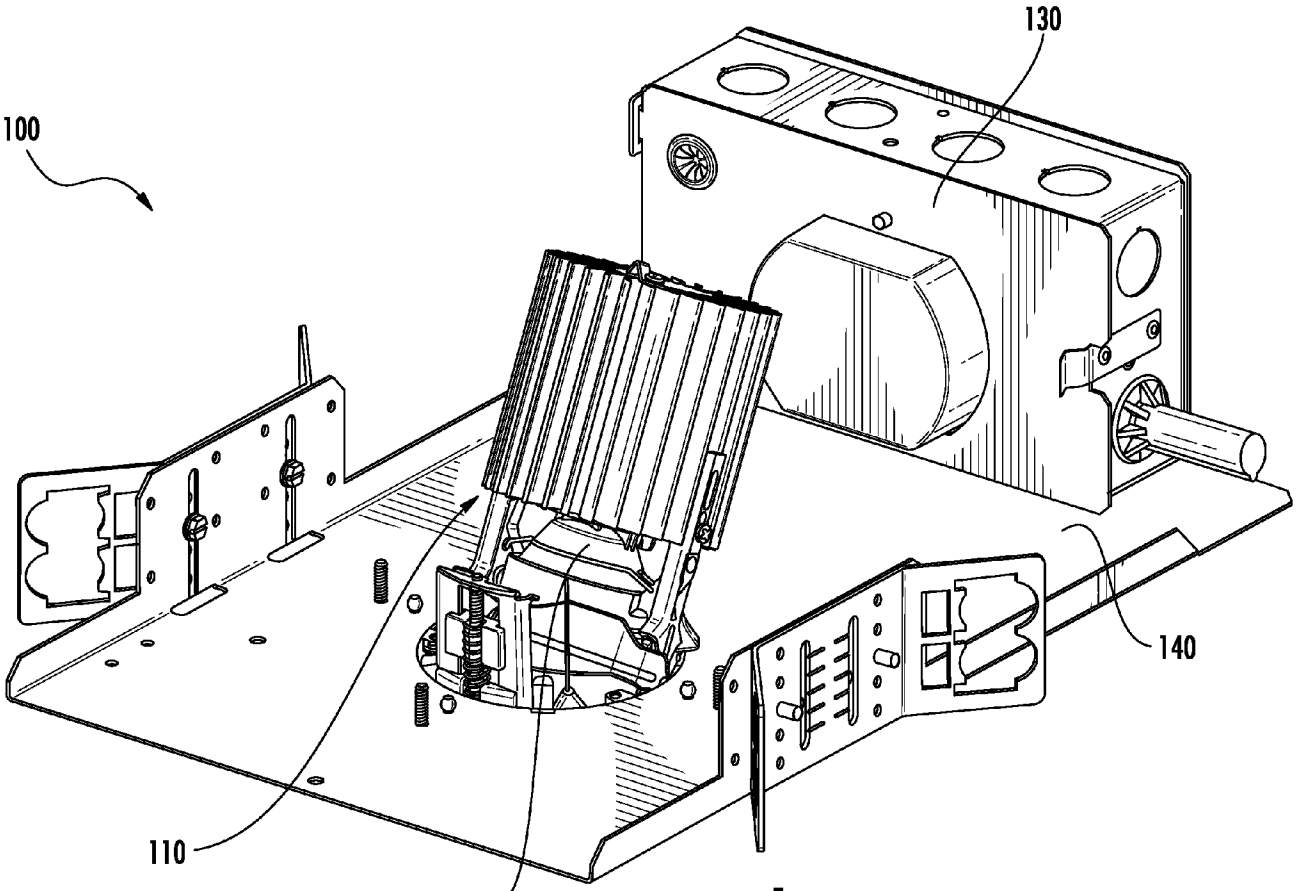
FIG. 1 illustrates an isometric view of an embodiment of a luminaire.

Turning to FIG. 1, an embodiment of a luminaire 100 is depicted. In particular, FIG. 1 depicts a luminaire 100 having an aiming system 110, with a light source 120, a junction box 130, and a support panel 140. In one implementation, the aiming system 110 of luminaire 100 comprises one or more mechanisms for adjusting a tilt angle and/or a rotation angle of light source 120, wherein said mechanisms are described in further detail in the figures that follow. In one example, light source 120 may comprise one or more light emitting diodes (LEDs). In another example, light source 120 may comprise an incandescent light bulb. In yet another example, light source 120 may be referred to as a lamp, wherein said lamp may be used to emit electromagnetic radiation in the visible spectrum, or outside of the visible spectrum, and using one or more lamp technologies, such as, among others, a halogen lamp, a xenon arc lamp, a metal-halide lamp, a gas-discharge lamp, a fluorescent lamp, a neon lamp, a mercury-vapor lamp, a sodium-vapor lamp, a sulfur lamp, and an electrodeless lamp. Furthermore, as will be readily apparent to those of ordinary skill in the art, light source 120 may represent multiple bulbs/lamps using a same, or different lamp technologies. Moreover, light source 120 may output light in the visible spectrum with any color temperature value. Additionally, light source 120 may be associated with a power consumption rating ranging from a fraction of a Watt (in one example, 0.1 W or below) to several kilowatts and above. Light source 120 may further comprise one or more lenses and/or filters for focusing and/or adjusting the light output intensity/color/pattern, and the like, as further described with reference to FIGS. 13-15. For example, in another implementation light source 120 may further comprise an electronic circuit having one or more light-emitting elements, an optic structure (otherwise referred to as a reflector, or a reflector dome), and/or a filter (otherwise referred to as a diffusing filter, and/or a lens), among others. Such elements are described in relation to FIGS. 13-15.

In one example, electrical wiring to luminaire 100 may be routed through junction box 130. Accordingly, junction box 130 may be similar to a conventional junction box that is readily known to those of ordinary skill in the art. For example, junction box 130 may have one or more internal features (not shown) for routing and/or connecting one or more wires and/or cables from one or more power supplies, and the like. In another example, light source 120 may operate using a standard household outlet voltage, which, in one example, may be 110-120 V at 60 Hz A.C. or 230-240 V at 50 Hz A.C., among others. In yet another example, light source 120 may operate using a D.C. voltage, or an A.C. voltage outside of a range of outlet voltages. As such, in one implementation, junction box 130 may comprise a transformer and/or a power supply device for stepping up/stepping down an input voltage and/or conditioning an alternating current (A.C.) input voltage to be a direct current (D.C.) voltage for supply to light source 120, and the like.

Luminaire 100 may have a support panel 140 for supporting aiming system 110. In one configuration, support panel 140 may be constructed from any material with a strength capable of supporting aiming system 110, and including, among others, a metal, an alloy, a polymer, or a fiber-reinforced material, or a wood, or combinations thereof. In one specific example, support panel 140 may comprise a stamped aluminum sheet/steel sheet, and the like. In one implementation, support panel 140 comprises an opening, for receiving the aiming system 110 such that the aiming system 110 can be recessed into (above) support panel 140, and light from light source 120 can be emitted out through said opening.

Figure 2:
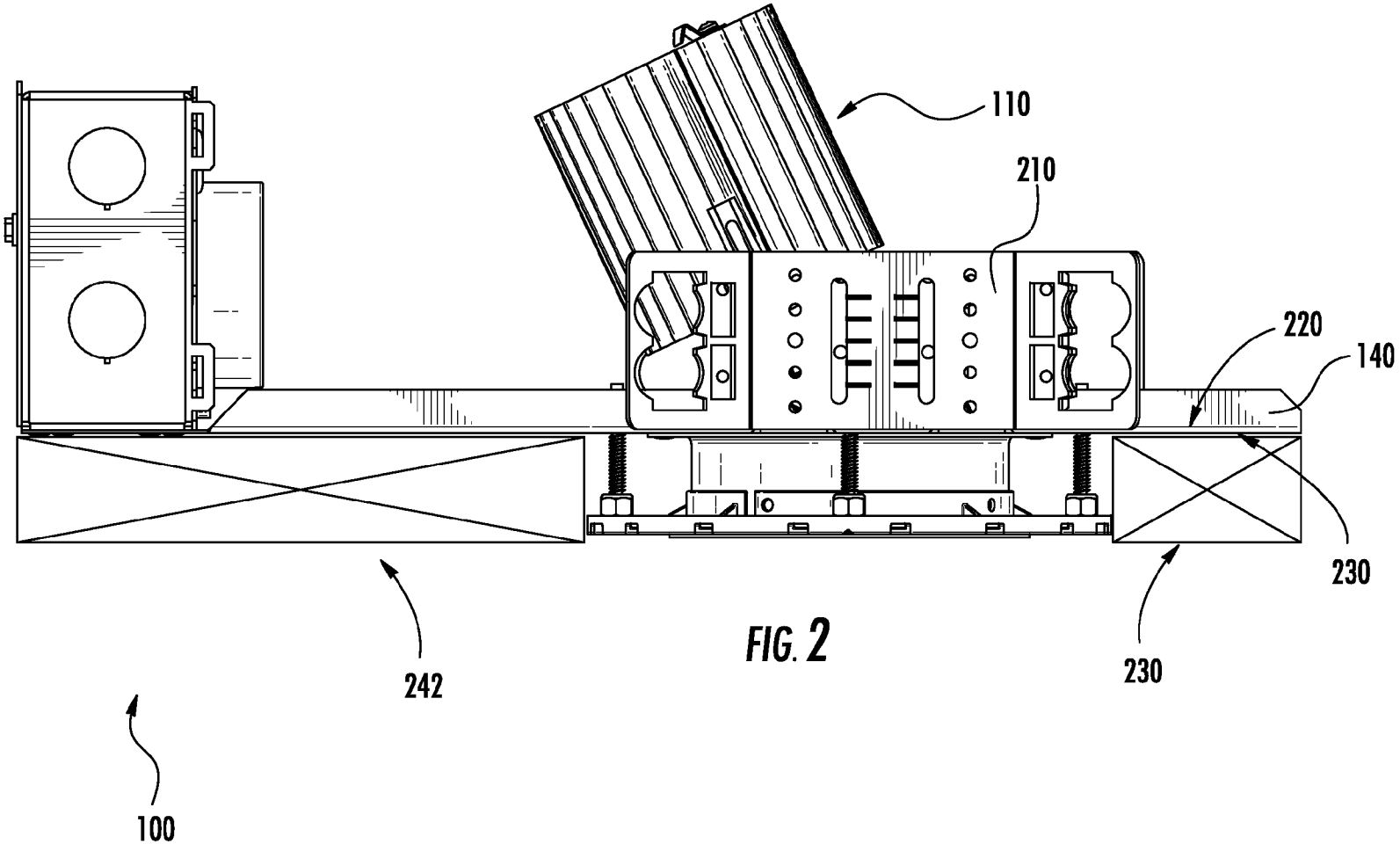
FIG. 2 illustrates a side view of an embodiment of a luminaire.

Looking to FIG. 2, a side view of luminaire 100 is depicted. FIG. 2 further depicts support panel 140 having an upper surface 220 and a lower surface 230. In one configuration, supports panel 140 may be mounted into a ceiling structure such that a lower surface 230 is substantially flush with a ceiling surface, and the like. In another example, lower surface 230 is configured to receive one or more ceiling components. As such, exemplary ceiling components depicted in FIG. 2 as components 240 and 242, wherein said exemplary ceiling components may include one or more of, among others, drywall, ceiling tiles, woodwork, and/or plaster, and the like. In one configuration, lower surface 230 comprises one or more elements for receiving a plaster material, wherein said one or more elements may comprise dimples, and the like, for encouraging adhesion between one or more areas of lower surface 230 and a plaster material. Support panel 140 further comprises one or more support brackets 210 for coupling support panel 142 to one or more ceiling structures. Those of ordinary skill in the art will recognize that support brackets 210 may comprise one or more apertures, and the like, for receiving one or more fasteners, including, but not limited to, screws, bolts, rivets, nails, staples, tabs, and the like. Furthermore, a configuration of one or more apertures and/or coupling-receiving elements may be of any known spacing/orientation/combination/pattern, without departing from the scope of the disclosure described herein.

Figure 3:
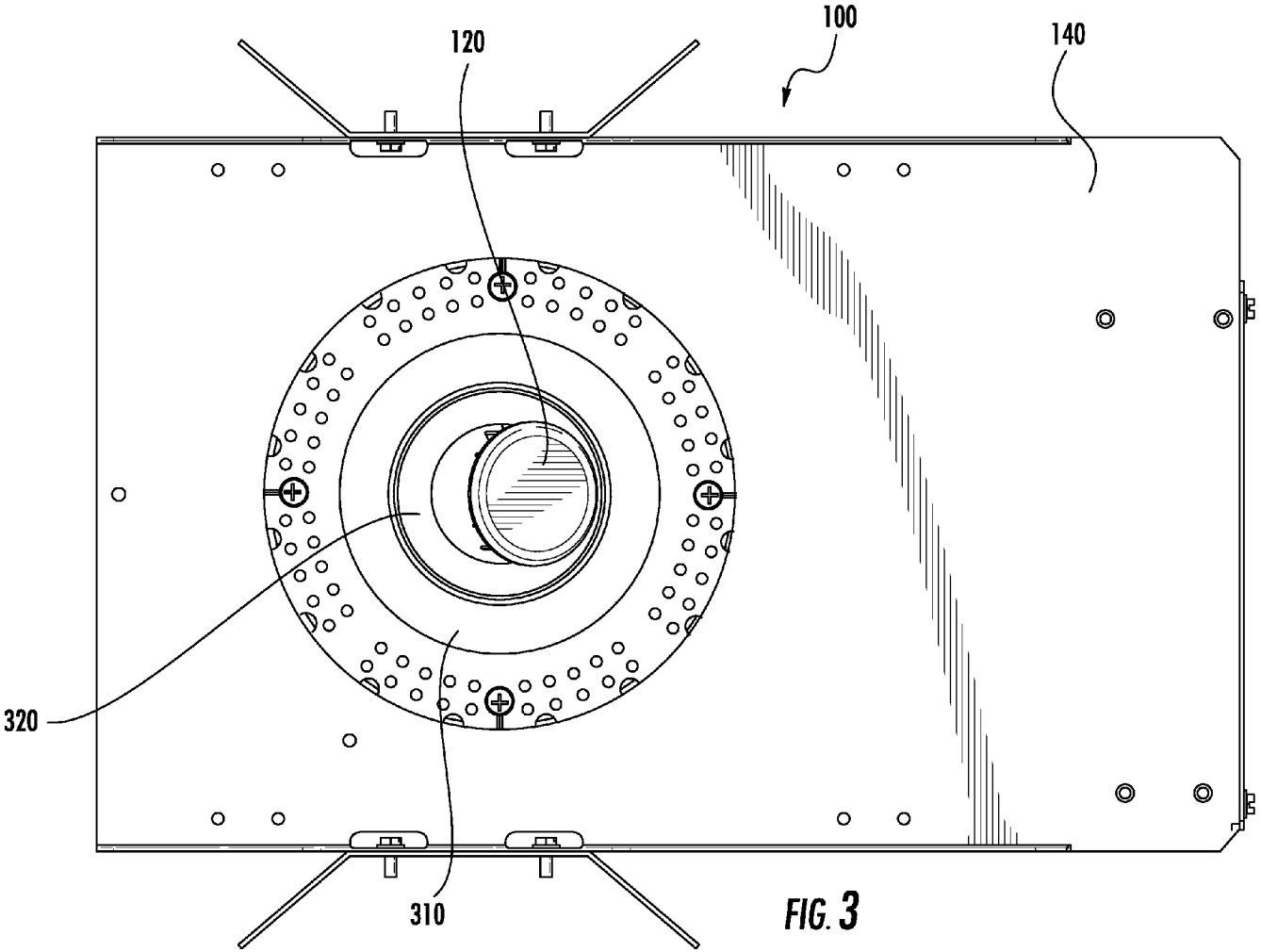
FIG. 3 illustrates a view of an underside of an exemplary embodiment of a luminaire.

FIG. 3 depicts a view of the underside of luminaire 100. In particular, FIG. 3 depicts the lower surface 230 of support panel 140, and without any ceiling elements. As will be apparent, support panel 140 obscures one or more elements of aiming system 110 depicted in FIG. 1 and FIG. 2, and such that light source 120 is primarily visible through an aperture 320 in support panel 140. In one configuration, aperture 320 may be substantially circular in shape, however any other shape may be utilized, without departing from the scope of this disclosure. For example, aperture 320 may be substantially rectangular in shape, or may comprise an oval shape, and the like. Additionally, a trim flange 310 may be visible from the underside of luminaire 100, wherein trim flange 310 may cover a gap between the structure of luminaire 100 and one or more ceiling components, such as, drywall, and the like (not shown).

Figure 4:
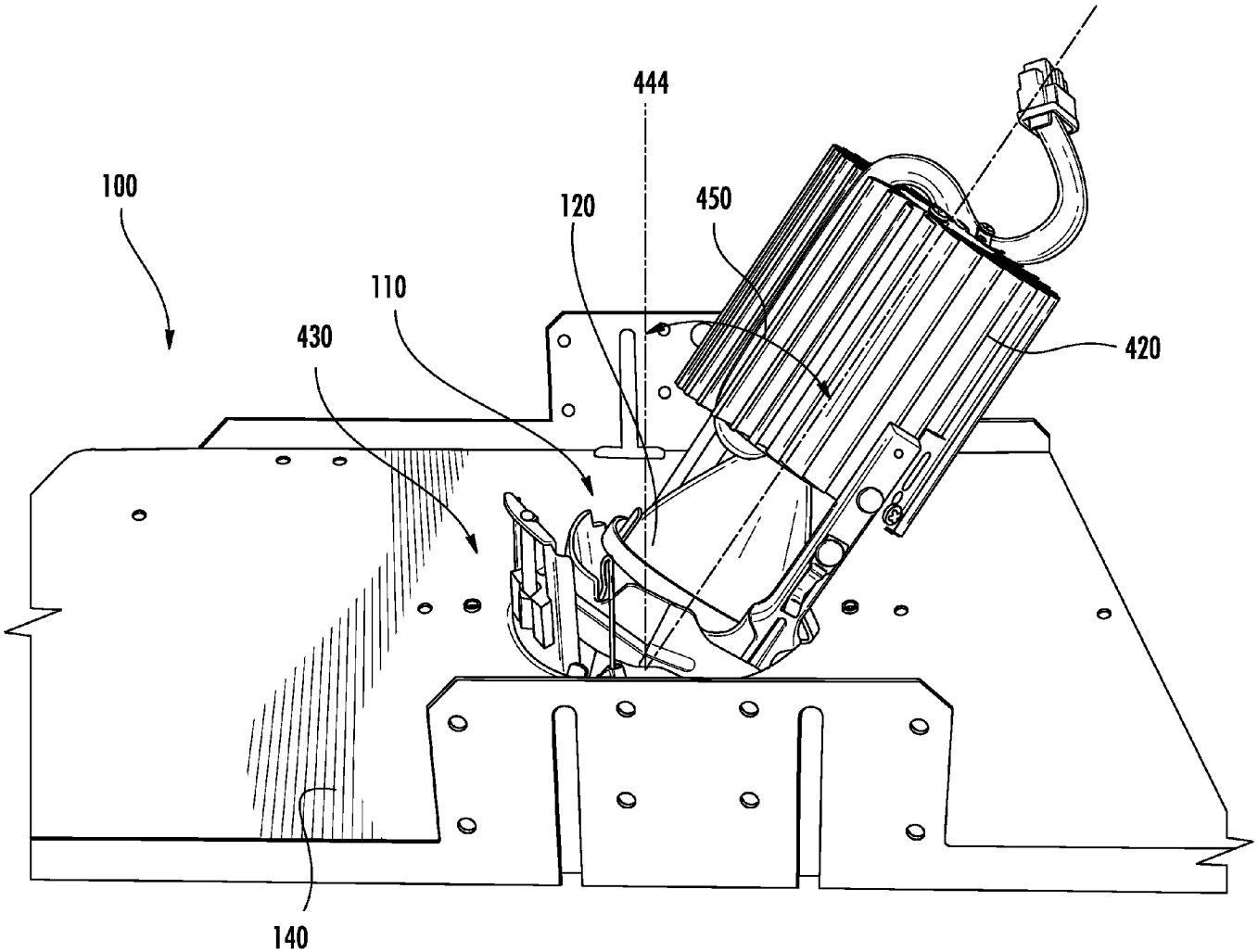
FIG. 4 illustrates a view of an exemplary embodiment of a luminaire with an aiming system configured in a first position.
Figure 5:
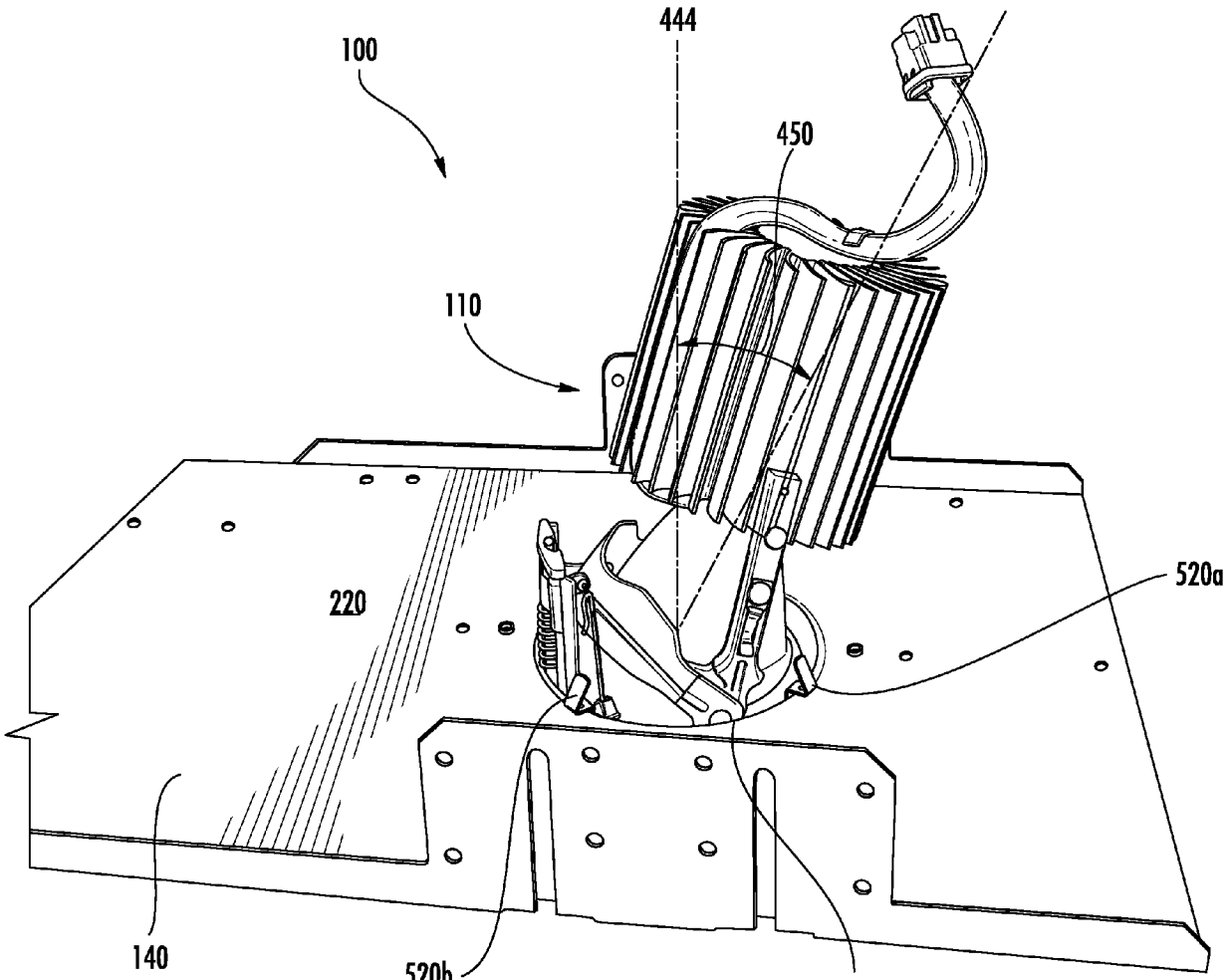
FIG. 5 illustrates a few of an exemplary embodiment of a luminaire with an aiming system configured in a second position.
Figure 6:
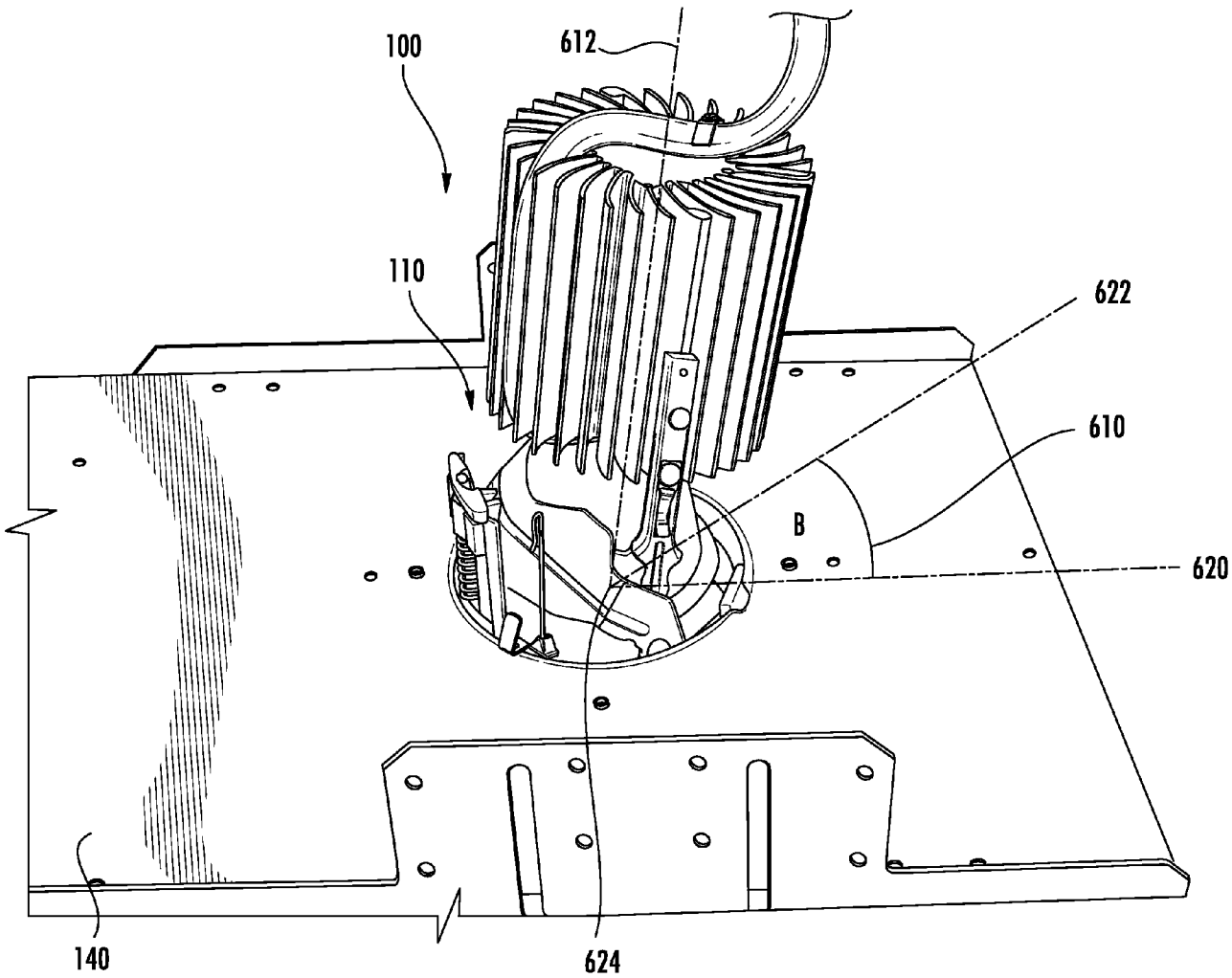
FIG. 6 illustrates a view of an exemplary embodiment of a luminaire with an aiming system configured in a third position.

Turning to FIGS. 4-6, which depict luminaire 100 with light source 120 in differing orientations. In particular, FIG. 4 depicts luminaire 100 having light source 120 at a first tilt angle, indicated as tilt angle 450. In one configuration, aiming system 110 comprises one or more mechanisms for adjusting an angle of light source 120 (tilt angle) using a tilt linkage 430. Tilt linkage 430 is described in further detail in FIGS. 11 and 12. In one example, the tilt angle 450 of light source 120 may be adjusted from an angle of approximately 0° to an angle of approximately 60°, and wherein said tilt angle 450 may be defined as an angle between a normal to the surface 220 of support panel 140 (normal is depicted as line 444), and a centerline 442, among others. Furthermore, and as will be apparent to those of ordinary skill in the art, a tilt angle may be defined with reference to one or more alternative planes and/or lines, without departing from the scope of this disclosure.

In one example, surface 220 may be substantially horizontal, wherein a horizontal, or level, plane may be referenced to a force of gravity. As such, normal 444 may be substantially vertical (orthogonal to surface 220). In another example, surface 220 may have a normal, such as normal 444, angled with any orientation without departing from the scope of this disclosure, wherein said orientation may be referenced to a force of gravity or another frame of reference using any coordinate system.

The luminaire 100 may further comprise a heatsink 420, as depicted in FIG. 4. Heatsink 420 may be configured to dissipate a heat energy output from light source 120 and may be comprised of, in one example, any material with thermal conductivity properties sufficient for transferring an amount of heat energy output of light source 120 and into a volume of surrounding ambient air, and the like. Accordingly, heatsink 420 may be comprised of a metal, or an alloy etc. In one example, heatsink 420 comprises one or more fins configured to increase the transfer from light source 120 to ambient air. In another example, heat transfer is augmented by one or more fans, thereby increasing an effective convective heat transfer coefficient for the illustrative heatsink 420.

In another example, heatsink 420 may comprise a light source holder, such that the heatsink 420 is directly coupled to light source 120 by any known coupling means, such as, for example, a screw, a bolt, a rivet, among others. In another example, heatsink 420 is coupled to light source 120 by one or more thermally conductive materials and/or elements, such as, among others, a heat pipe, or a conductive plate or cable.

FIG. 4 depicts aiming system 110 of luminaire 100 having a first tilt angle 450. In one example, said first tilt angle 450 may be, approximately 40°. FIG. 5 depicts luminaire 100 with a steeper tilt angle to that depicted in FIG. 4. For example, FIG. 5 depicts luminaire 100 with a second tilt angle 450 of approximately 20°.

Additionally, FIG. 5 depicts a rotation mechanism 510 of aiming system 110. In one configuration, rotation mechanism 510 is configured to allow aiming system 110 to rotate about an axis of rotation (discussed in further detail in relation to FIG. 6). Accordingly, in one configuration, said rotation may be in relation to support panel 140, wherein rotation mechanism 510 may rotate aiming system 110 in relation to support panel 140 using rotation spring mechanisms 520*a* and 520*b*. In one example, rotation spring mechanisms 520*a*-520*b* may be leaf springs configured to abut the upper surface 220 of support panel 140 while having the ability to rotate relative to surface 220, facilitated by rotation mechanism 510. In one example, one or more rotation spring mechanisms 520*a* and 520*b* may bear a weight of aiming system 110 on support panel 140, and such that rotation spring mechanisms 520*a* and 520*b* exert a spring force capable of bearing the weight of aiming system 110. In another example, rotation mechanism 510 may comprise three or more rotation spring mechanisms 520, and the like. In yet another example, a cumulative spring force (as a result of a selected one or more spring constants of rotation spring mechanisms 520) exerted by one or more rotation spring mechanisms 520*a*-520*b* on the upper surface 220 of support panel 140 may be above a weight of aiming system 110, and below a force threshold such that aiming system 110 may be removed by a user, from support panel 140, without requiring any specialized tools (in one embodiment, aiming system 110 may be removed from support panel 140 by hand, and the like).

Figure 11:
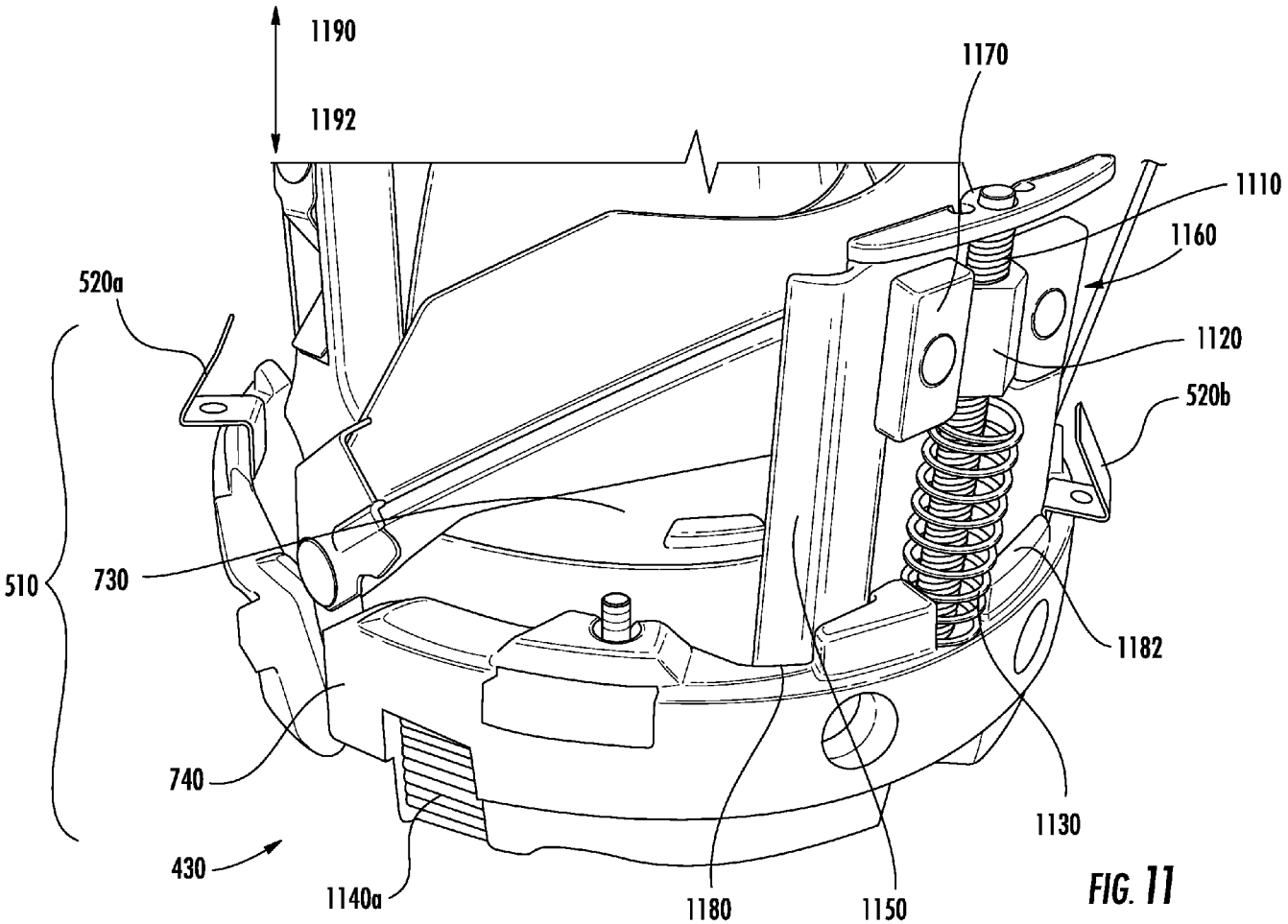
FIG. 11 depicts a detailed view of a tilt linkage.

In one example, rotation spring mechanisms 520*a* and 520*b* may have an extended position such that rotation spring mechanisms 520*a* and 520*b* contact the upper surface 220 of support panel 140, and such that aiming system 110 is rotatably coupled to support panel 140. In particular, rotation spring mechanisms 520*a* and 520*b* may contact, and rotate relative to upper surface 220, while one or more tab structures (not shown), extending from rotation mechanism sleeve 740 (as depicted in FIG. 11), contact, and rotate relative to lower surface 230 of support panel 140. Accordingly, rotation spring mechanisms 520*a* and 520*b* may facilitate insert/removal of aiming system 110 from support panel 140. In particular, rotation spring mechanisms 520*a* and 520*b* may, upon application of a force exerted by a user in a direction normal to the lower surface 230 of support panel 140, compress to allow aiming system 110 to be inserted/removed from support panel 140. As such, rotation spring mechanisms 520*a* and 520*b* may facilitate insertion and/or removal of any system 110 from support panel 140 using a spring compression fit, and without using a screw-in coupling, or a keyed coupling, and the like.

FIG. 6 depicts luminaire 100 with a first rotation angle 610. In one configuration, aiming system 110 may rotate relative to support panel 140 about an axis of rotation 612. Accordingly, in one example, the axis of rotation 612 may be about a centerline of/axis of symmetry through aiming system 110. In another example, the axis of rotation 612 may be different to an axis of symmetry through aiming system 110, and wherein, in one example, aiming system 110 is not symmetrical about an axis. In one example, rotation angle 610 may be defined as that angle between a first line 620 and a second line 622, wherein lines 620 and 622 extend radially from a center point 624, and wherein said center point 624 may, in one example, coincide with a geometric center of aperture 320. In one example, the rotation angle 610 may be up to 360 degrees, thereby allowing the aiming system 110 to rotate around the entire opening in the support panel 140.

Figure 7:
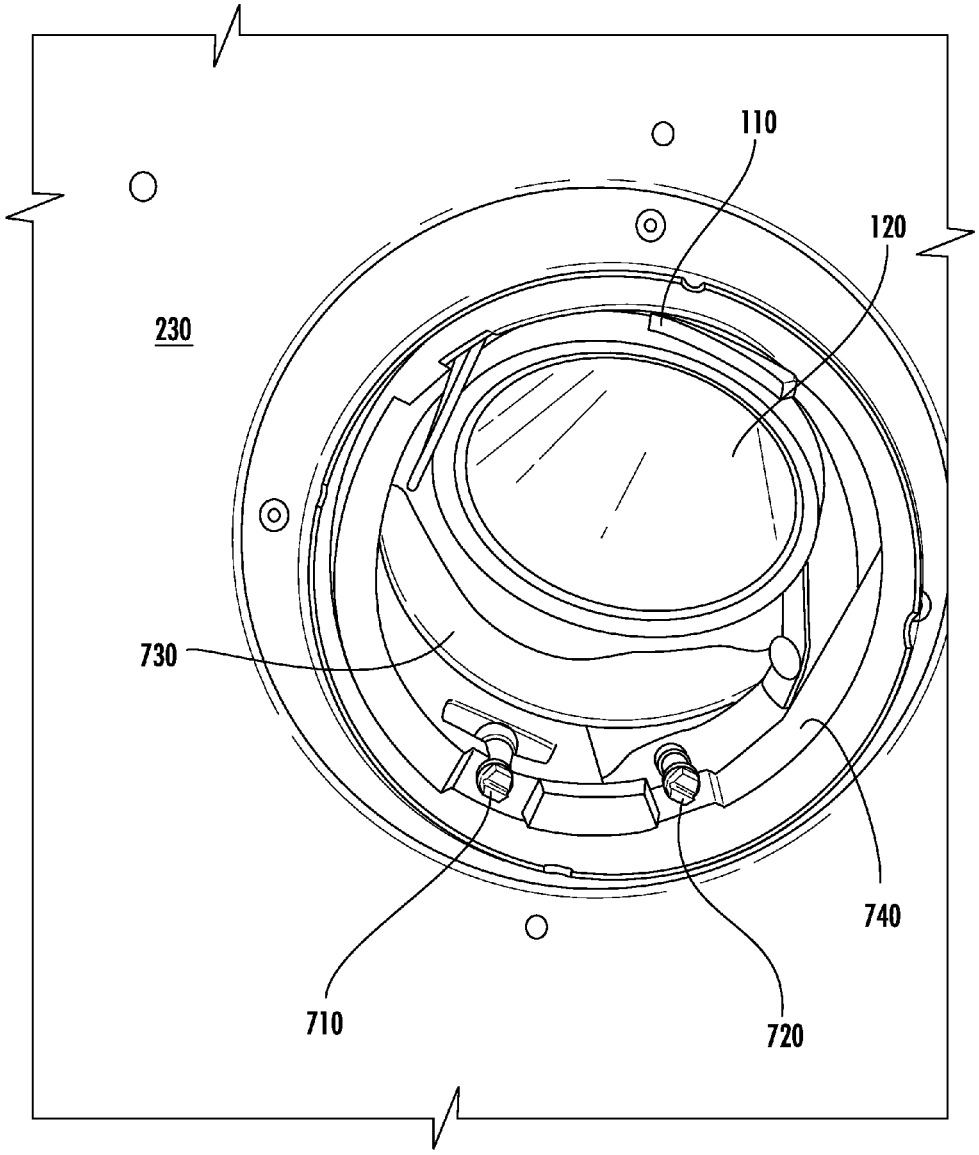
FIG. 7 illustrates a detailed view of an underside of an exemplary embodiment of a luminaire.

FIG. 7 depicts a detailed view of a lower surface 230 of support panel 140. In particular, FIG. 7 depicts light source 120 coupled to aiming system 110. Furthermore, aiming system 110 may comprise a rotation mechanism sleeve 740, otherwise referred to as an internal sleeve. Additionally, aiming system 110 is depicted as comprising an aiming system internal light shield 730, wherein said internal light shield is configured for reflecting an amount of light out from luminaire 100 such that said amount of light is not incident on one or more components above the upper surface 220 of support panel 140. In another example, the internal light shield 730 is configured to block a view of one or more elements of luminaire 100 above upper surface 220 of support panel 140. Accordingly, internal light shield 730 may obscure a view of one or more elements, such as, among others, elements 110 and/or 420, among others, when viewed by an observer from below a lower surface 230 of support panel 140. Accordingly, in one example, light shield 730 reduces the amount of light "bleeding" into the structure of luminaire 100 above upper surface 220. In the depicted configuration, rotation mechanism sleeve 740 comprises a tilt member 710 and a rotation member 720. In one example, tilt member 710 may comprise an interface configured for actuation of a tilt mechanism, wherein said tilt mechanism is described in further detail in relation to FIG. 11. Accordingly, tilt member 710 may, in one example, provide a component which may be rotated in order to adjust a tilt angle, such as tilt angle 450, of aiming system 110. Specifically, tilt member 710 may be configured as a screw head and/or a hexagonal cap. Accordingly, tilt member 710 may be configured with a Phillips, a slot, a Pozidriv, a square, a Robertson, a hex, a hex socket, a security hex socket, a Torx, a security Torx, a spanner head, a triple square, or a poly drive screw drive type, among others. Accordingly, tilt member 710 may be configured to interface with one or more of a screwdriver, a wrench, a socket wrench, a hex key/allen key, or a specialized/proprietary actuation tool, among others. In one example, tilt member 710 may be coupled to screw drive 1110 from FIG. 11.

Rotation member 720 may be similar to tilt member 710, and such that rotation member 720 may be configured for actuation of a rotation mechanism, such as rotation mechanism 510. In one configuration, rotation member 720 may have a same, or a different screw drive type as tilt member 710. In one implementation, rotation member 720 may, in addition to actuating rotation mechanism 510, be configured for actuation of a locking mechanism (not shown). Accordingly, upon rotation of rotation member 720 about its own axis, a locking mechanism may prevent rotation mechanism 510 from rotating about axis of rotation 612. In one example, rotation member 720 may be coupled to a threaded member, wherein upon rotation of rotation member 720, said threaded member may move into contact with a surface of support panel 142 prevents rotation of aiming system 110 about said support panel 140, and the like. In another example, when said locking mechanism is configured in an unlocked configuration, tilt member 710 may additionally/alternatively be utilized to rotate rotation mechanism sleeve 740 about rotation axis 612.

Figure 8:
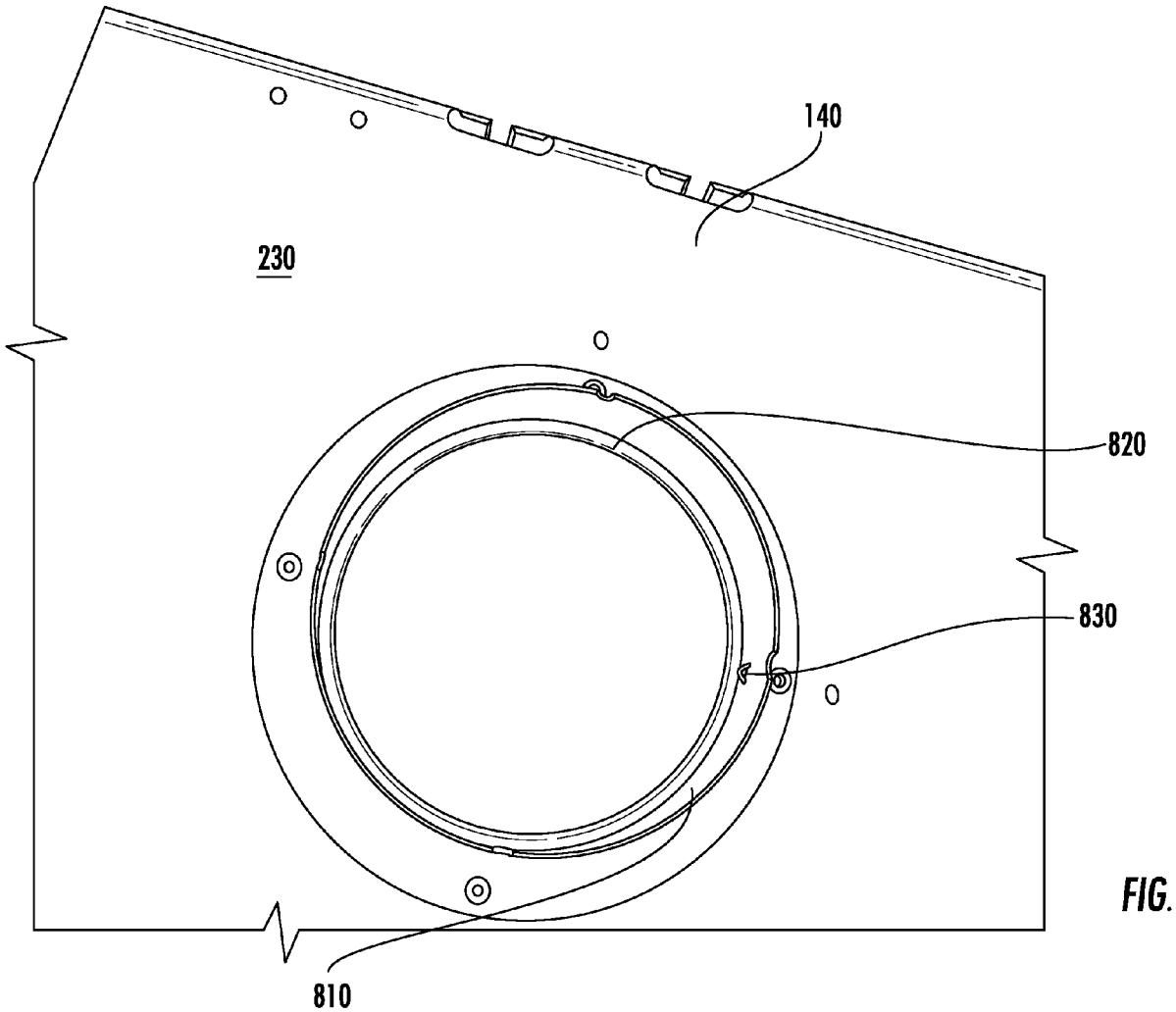
FIG. 8 depicts a view of a support panel structure.

FIG. 8 depicts an alternative view of the lower surface 230 of support panel 140. In particular, support panel 140 is depicted without aiming system 110 in situ. As such, FIG. 8 depicts support panel 140 having a support sleeve 810, a support flange 820, and a rotation stop 830. In one configuration, support sleeve 810 is configured as a substantially cylindrical structure extending from the lower surface 230 of support panel 140. In one configuration, support sleeve 810 is configured to contact rotation mechanism sleeve 740, and such that rotation mechanism sleeve 740 may rotate relative to support sleeve 810 about a center point of support sleeve 810.

Figure 12A:
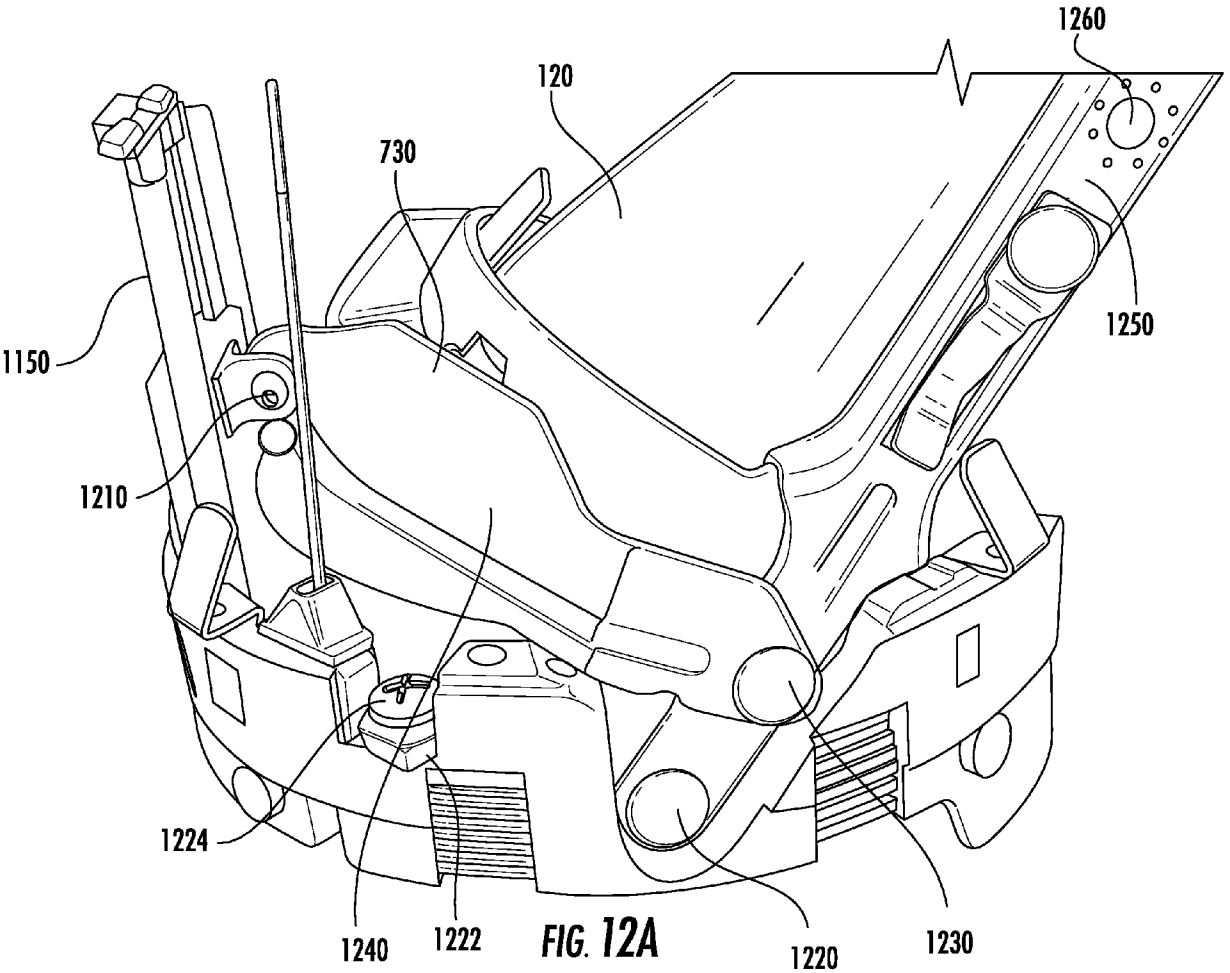
FIGS. 12A-12C illustrate detailed views of a tilt linkage with a light source having adjustable tilt angles.

Rotation stop 830 may be configured to prevent rotation of aiming system 110 through a rotation angle, such as rotation angle 610, of, in one example, greater than 370°. In another example, rotation stop 830 may be configured to prevent rotation of aiming system 110 through an angle greater than 365°, 362°, or 360°, among others. Accordingly, rotation stop 830 may comprise a tab structure projecting from support sleeve 810, and configured to contact a corresponding rotation tab 1222 projecting from rotation mechanism sleeve 740 (as depicted in FIG. 12A).

In one configuration, support flange 820 may be coplanar with lower surface 230. Accordingly, in one example, support flange 820 may be positioned between rotation mechanism sleeve 740 and rotation mechanism springs 520*a* and 520*b*, thereby rotatably coupling aiming system 110 to support panel 140. Accordingly, upon insertion of aiming system 110 into luminaire 100, one or more rotation mechanism springs 520*a*-520*b* may be compressed by support flange 820. As aiming system 110 is seated into position within luminaire 100, the one or more compressed rotation mechanism springs 520*a*-520*b* decompress/expand into a position on upper surface 220 of support panel 140, as depicted in FIG. 5, among others.

Figure 9:
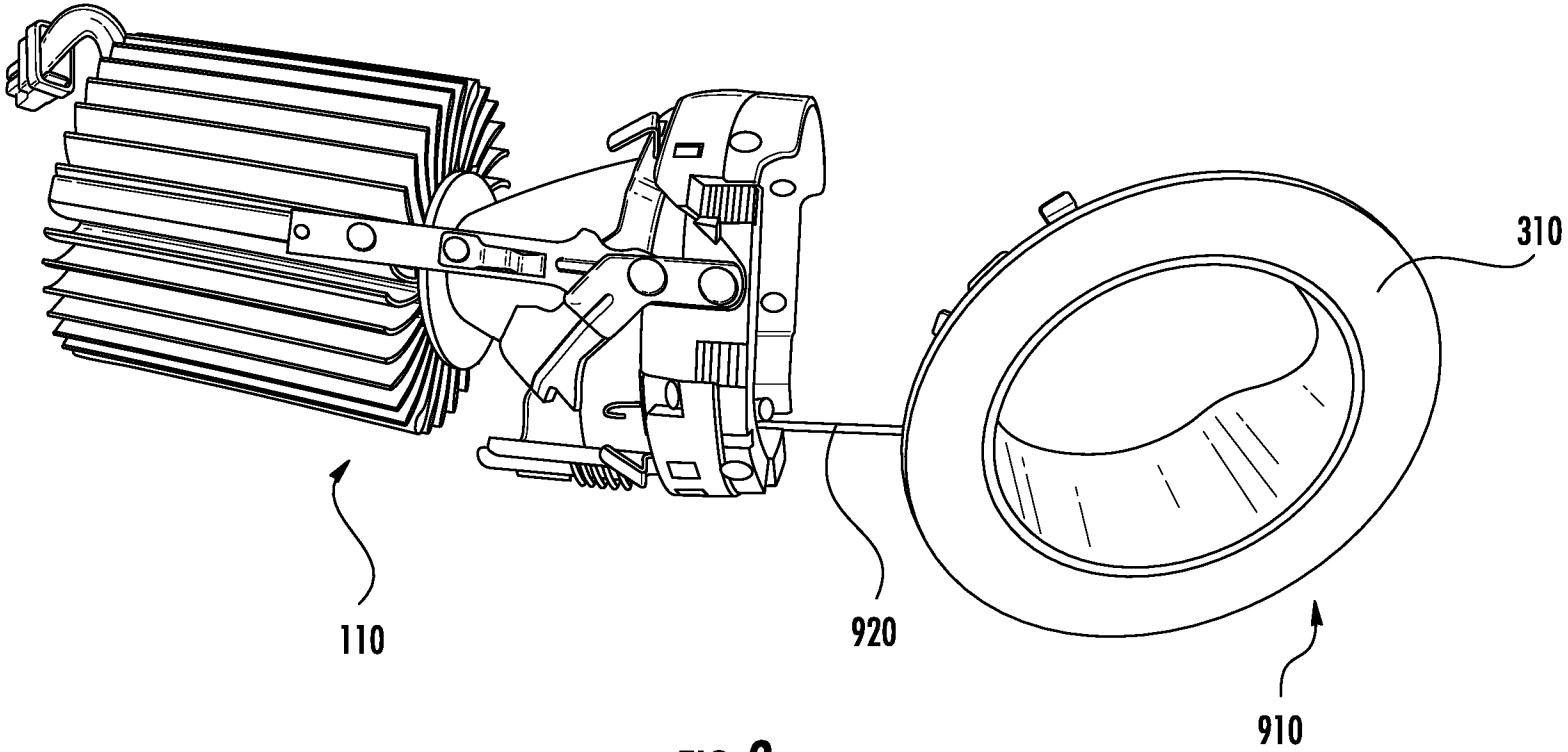
FIG. 9 illustrates one exemplary embodiment of a coupling of an aiming system to a trim assembly.

FIG. 9 depicts aiming system 110 loosely coupled to a trim assembly 910 by a safety wire 920. In one example, trim assembly 910 trim assembly 910 comprises the trim flange 310 from FIG. 3. FIG. 9 depicts aiming system 110 removed from support panel 140, as will be the case prior to installation of aiming system 110, or during times of maintenance and/or replacement of any system 110. Accordingly, when positioned in support panel 140, aiming system 110 may be coupled to trim assembly 910 trim assembly 910 by a secondary means. Said secondary means is discussed in further detail in relation to FIG. 10. As such, FIG. 9 serves to indicate that aiming system 110 may be loosely coupled to said trim assembly 910 trim assembly 910 by safety wire 920 such that, in one example, trim assembly 910 trim assembly 910 may be removed in order to access one or more of tilt member 710 and/or rotation member 720, and without allowing complete separation of trim assembly 910 trim assembly 910 from aiming system 110.

In one example, safety wire 920 may be utilized to orient trim assembly 910 such that when trim assembly 910 is loosely coupled to aiming system 110, safety wire 920 may be utilized to maintain a correct orientation/alignment of trim assembly 910 relative to aiming system 110.

Figure 10:
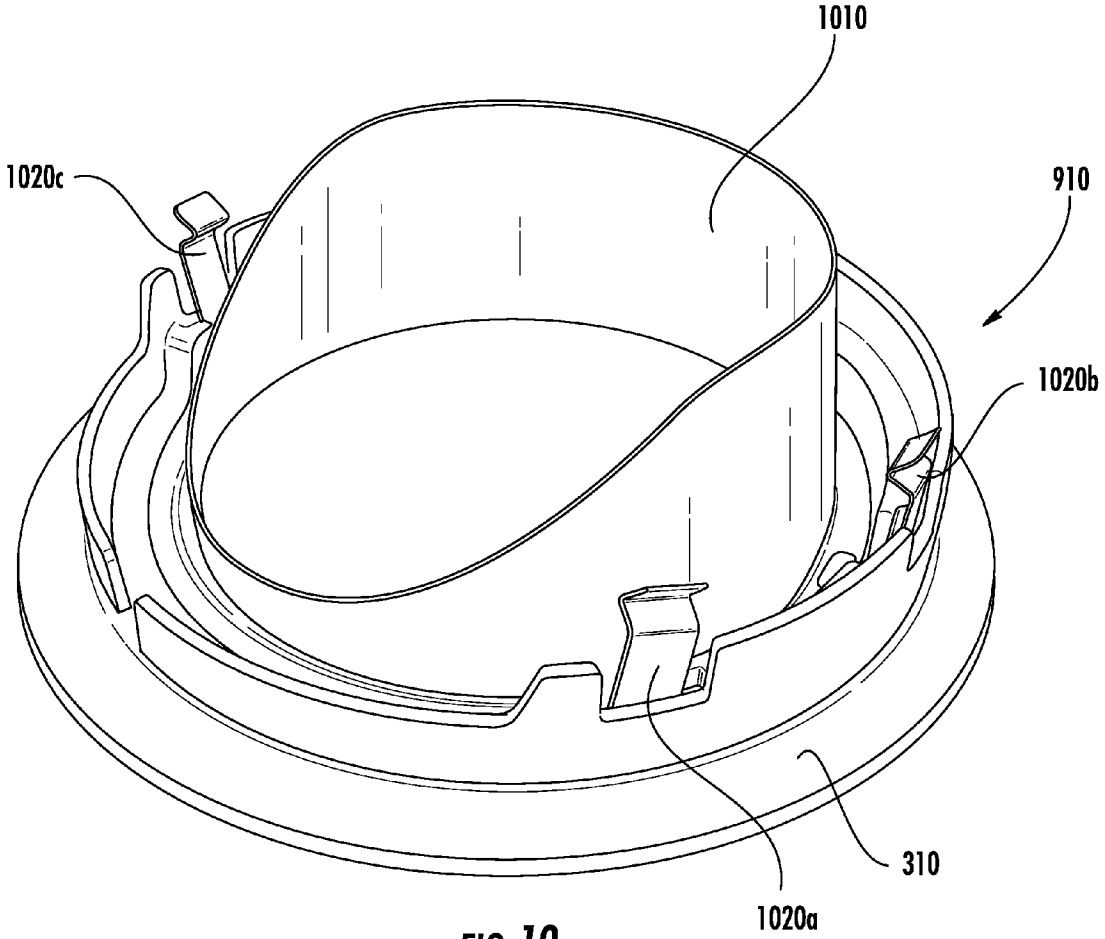
FIG. 10 illustrates an isometric view of an exemplary embodiment of a trim assembly.

FIG. 10 depicts an alternative view of trim assembly 910. In particular, FIG. 10 depicts trim assembly 910 having the trim flange 310, a trim assembly light shield 1010, and leaf spring keys 1020*a*-1020*c*. In one example, trim assembly 910 may be coupled to aiming system 110 using leaf spring keys 1020*a*-1020*c*. As such, a leaf spring key 1020*a*/1020*b*/1020*c* may be received into a trim assembly keyway 1140, as depicted in FIG. 11. In one example, and as previously discussed, a coupling between trim assembly 910 and aiming system 110 using leaf spring keys 1020*a*-1020*c* may be in addition to a loose coupling facilitated by safety wire 920. Accordingly, in one example, safety wire 920 may be utilized to orient trim assembly 910 relative to aiming system 110 such that a correct positioning of leaf spring keys 1020*a*-1020*c* is maintained relative to trim assembly keyway 1140. Accordingly, in one example, trim assembly 910 may be rigidly coupled to aiming system 110 using leaf spring keys 1020*a*-1020*c* such that the rigid coupling is keyed (e.g. a "snap-fit"), and without using a screw-in fit.

In one configuration, trim assembly light shield 1010 reflects an amount of light out from luminaire 100. In another configuration, trim assembly light shield 1010 prevents an amount of light from being projected into an area above the upper surface 220 of support panel 140.

FIG. 11 depicts a detailed view of tilt linkage 430. In particular, tilt linkage 430 comprises rotation mechanism sleeve 740 coupled to a support bracket 1150, the support bracket 1150 supporting a linear actuator mechanism 1160.

Further, the linear actuator mechanism 1160 may comprise a carrier structure 1170, a screw drive 1110, nut 1120, and coil spring 1130. Also depicted FIG. 11 is a trim assembly keyway 1140*a*, as described in relation to FIG. 10, and configured to receive a leaf spring key 1020 of trim assembly 910. Additionally, FIG. 11 depicts rotation mechanism springs 520*a*-520*b*, as described in relation to FIG. 5, and configured for rotatably coupling aiming system 110 to support panel 140. It is noted that while two rotation mechanism springs 520*a*-520*b* are depicted in FIG. 11, other embodiments may be envisaged as having more than two rotation mechanism springs 520, or a single rotation mechanism spring 520. Also depicted in FIG. 11 is light shield 730, wherein light shield 730 is coupled to the linear actuator mechanism 1160, as described in further detail below.

In one embodiment, one or more components of tilt linkage 430 may be constructed from aluminum and/or steel. However, those of ordinary skill in the art will recognize that one or more components of tilt linkage 430 may, additionally or alternatively, be constructed from, among others, a metal other than aluminum, an alloy other than steel, a polymer, a fiber reinforced material, or a wood, or combinations thereof. Furthermore, a coupling between two or more components of tilt linkage 430 may comprise one or more of a screw, a rivet, a pin, a weld, a braze, a staple, a bolt, a nail, an interference fit, a key and keyway coupling, a threaded coupling, or any other means of joining two or more components known to those of ordinary skill in the art.

In one configuration, rotation mechanism sleeve 740 is comprises a substantially circular shape. Support bracket 1150 may be rigidly coupled to the rotation mechanism sleeve 740 as depicted, wherein support bracket 1150 comprises a substantially rectangular shape, having a first leg coupled to the rotation mechanism sleeve 740 at coupling point 1180, and a second leg coupled to the rotation mechanism sleeve 740 at coupling point 1182. In one example, support bracket 1150 may be coupled to a screw drive 1110, such that screw drive 1110 is free to rotate in response to actuation of rotation member 720, as described in FIG. 7. In one example, carrier structure 1170 is coupled to screw drive 1110 by nut 1120 such that, upon actuation of screw drive 1110, nut 1120 converts rotational motion of said screw drive 1110 into linear motion of carrier structure 1170 along a length of screw drive 1110. In one example, screw drive 1110 has a spring 1130, which may be a coil spring, positioned around screw drive 1110, and such that a first end of spring 1130 abuts rotation mechanism sleeve 740, as depicted. Additionally, a second end of spring 1130 may contact a surface of nut 1120 such that, upon actuation of linear actuator mechanism 1160, spring 1130 may be compressed. Specifically, bringing carrier structure 1170 towards rotation mechanism sleeve 740 in a downward direction, wherein said downward direction as indicated by arrow 1192, nut 1120 may contact, and compress, spring 1130. As such, a spring force exerted by spring 1130 on nut 1120 may counterbalance a weight of aiming system 110. This counterbalancing (partial or wholly counterbalancing) of a spring force, from spring 1130, with a weight of aiming system 110 may allow linear actuator mechanism 1160 to be actuated using a lower manual rotation force to actuate rotation member 720 in order to translate carrier structure 1170 in an upward direction, as indicated by arrow 1190.

In one example, tilt linkage 430 may be utilized as an anti-backlash system, wherein a spring force exerted by spring 1130 on rotation mechanism sleeve 740 and nut 1120 may be utilized to ensure that actuation of screw drive 1110 results in linear translation of carrier structure 1170 without/with a reduced amount of backlash. In other words, a spring force exerted as a result of compression of spring 1130 between nut 1120 and rotation mechanism sleeve 740 may allow for, upon actuation of tilt member 710 from FIG. 7, a reduced amount of backlash/no backlash before said actuation of member 710 is converted into linear motion of carrier structure 1170.

Figure 12B:
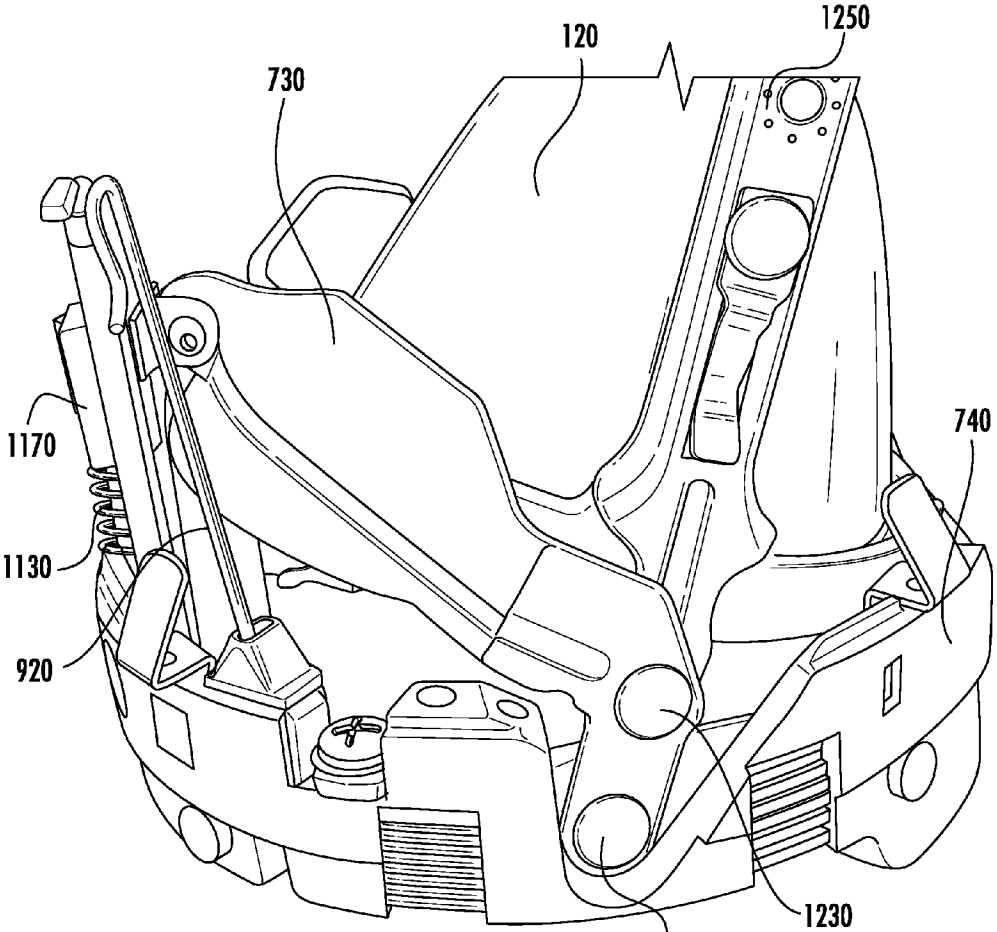
Figure 12C:
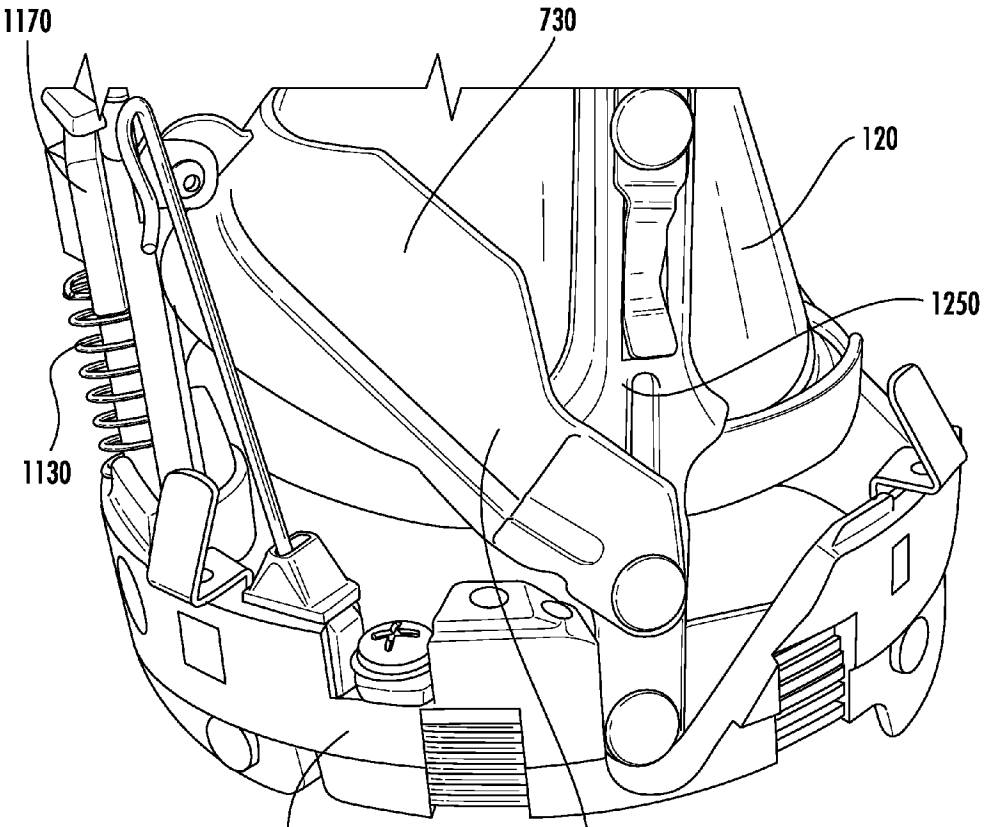

Conversion of said linear motion of carrier structure 1170 into a rotational motion of aiming system 110 is described in further detail in relation to FIGS. 12A-12C. It is noted that those directions indicated by arrows 1190 and 1192 may be co-linear, and may be parallel to a normal 444, as depicted in FIG. 4. It is also noted that the terms "upward" and "downward" used in relation to arrows 1190 and 1192, respectively, are merely one example of an orientation of tilt linkage 430. In another example, arrows 1190 and 1192 may be oriented in downward and upward directions, respectively. In yet another example, arrows 1190 and 1192 may be oriented in any orientation, and using any frame of reference and coordinate system, and the like.

FIG. 12A depicts an alternate view of tilt linkage 430 from that depicted FIG. 11. In one configuration, and as shown in FIG. 12A, tilt linkage 430 comprises rotation mechanism sleeve 740 coupled to linear actuator mechanism 1160, and having further couplings to a light shield bracket 1240 and light source support structure 1250. In one example, as depicted in FIG. 12A, light shield bracket 1240 comprises a substantially semicircular armature configured to substantially conform to a circular shape of a light source 120. Light shield bracket 1240 is coupled to the carrier structure 1170 at pivot point 1210, and such that said coupling allows light shield bracket 1240 to pivot relative to the carrier structure 1170 as carrier structure 1170 translates in a linear direction along screw drive 1110.

Rotation mechanism sleeve 714 may be coupled to a light source support structure 1250 at a pivot point 1220, wherein pivot point 1220 is positioned at first end of the light source support structure 1250, and the like. In one example, light source support structure 1250 comprises a frame structure configured to support a light source 120, and such that light source 120 is rigidly coupled to light source support structure 1250. As such, an adjustment of a rotation angle and/or a tilt angle of light source 120 may be achieved by rotating and/or tilting light source support structure 1250. Additionally, light source support structure 1250 may be coupled to one or more heatsinks, such as heatsink 420 depicted in FIG. 4. As such, light source support structure 1250 may be coupled to light source 120 and and/or heatsink 420 at a second end 1260. In one configuration, light shield bracket 1240 is rotatably coupled to light source support structure 1250 at pivot point 1230, wherein pivot point 1230 is located between the first end (indicated by pivot point 1220) and the second end (indicated by element 1260) of light source support structure 1250. Furthermore, in one configuration, the coupling of light shield bracket 1240 to light source support structure 1250 at pivot point 1230, in combination with the coupling of light source support structure 1250 to rotation mechanism sleeve 740 at pivot point 1220 may be repeated (mirrored) on an opposite side of rotation mechanism sleeve 740 that is diametrically opposed to pivot point 1220.

In one example, a rotation tab 1222 projects from rotation mechanism sleeve 740, wherein rotation tab 1222 is coupled to rotation sleeve 740 by fastener 1224. Accordingly, as will be readily apparent to those of ordinary skill in the art, fastener 1224 may comprise any known fastening means such as, among others, a screw, a rivet, a bolt, a nail, a pin, among many others. In one example, rotation tab 1222 is configured to contact rotation stop 830 of support sleeve 810, and such that aiming system 110 may be constrained to rotation through an angle of 370° or less. In another example, rotation may be constrained to an angle of 365°, 362°, or 360° or less. In one example, rotation tab 1222 may be pivoted such that tab 1222 does not project from rotation sleeve 740, and such that rotation of aiming system 110 relative to support sleeve 810 and a rotation stop 830 is not constrained to, in one example, an angle of 370° or less.

In one configuration, a coupling of light shield bracket 1240 to carrier structure 1170 at pivot point 1210, in addition to a coupling of light shield bracket 1240 to light source support structure 1250 at pivot point 1230, allows a linear motion of carrier structure 1170 to be converted into a rotational motion of light source support structure 1250, and consequently, light source 120. Described in further detail, actuation of rotation member 720 may actuate screw drive 1110, thereby linearly translating carrier structure 1170 in an upward direction, indicated by arrow 1190. This linear motion of carrier structure 1170 is translated into a rotational motion of light shield bracket 1240 through pivot point 1210. Rotational motion of light shield bracket 1240 is accompanied by motion of pivot point 1210 of light shield bracket 1240 in an upward direction, wherein said upward direction is indicated by arrow 1190. As pivot point 1210 of light shield bracket 1240 is moved in an upward direction, pivot point 1230 of light shield bracket 1240 moves towards support bracket 1150. Conversely, as carrier structure 1170 moves in a downward direction, indicated by arrow 1192, pivot point 1230 moves away from support bracket 1150. As such, a motion of pivot point 1230 towards/away from support bracket 1150 gives rise to a leverage that may rotate light source support structure 1250 about pivot point 1220. Successive steps in a motion of light source support structure 1250 are depicted in FIG. 12A-12C. Accordingly, FIG. 12A depicts light source support structure 1250 at a first tilt angle, wherein said first tilt angle may be approximately 30°, and wherein the first tilt angle is referenced relative to a normal (e.g. normal 444) to an upper surface 220 of support panel 140, similar to tilt angle 450 from FIG. 4. In this example of FIG. 12A, carrier structure 1170 is positioned at a lower end of screw drive 1110, thereby setting up a steep/high tilt angle of light source support structure 1250. Turning to FIG. 12B, carrier structure 1170 is depicted as positioned approximately midway along screw drive 1110. As such, as carrier structure 1170 is translated in an upward direction (direction 1190), this linear motion gives rise to rotational motion of light source support structure 1250 into a more upright position, and having a shallower tilt angle. In one example, the tilt angle depicted in FIG. 12B may be approximately 15°. It will be noted that during translation of carrier structure 1170 along screw drive 1110 in the upward direction 1190, spring 1130 may exert a spring force on a surface of nut 1120, thereby counterbalancing a weight (partially or wholly) of aiming system 110.

In one example, safety wire 920 may be retracted into rotation mechanism sleeve 720, as depicted in FIG. 12A-12C. This retracted position of safety wire 920 corresponds to a configuration coupling cartridge 910 to rotation mechanism sleeve 920, as previously described.

Returning to FIG. 12C, carrier structure 1170 is depicted in a position at a substantially upper end of screw drive 1110, wherein screw 1130 is in a fully decompressed position, and light source support structure 1250 has been pulled into an upright position by light shield bracket 1240. In one example, light source support structure 1250, and as such, light source 120, have a tilt angle of approximately 0° in FIG. 12C.

FIG. 12A-C further depicts aiming system internal light shield 730 coupled to light shield bracket 1240, wherein light shield 730 moves as a tilt angle of light source 120 is adjusted, as depicted in the sequence of FIG. 12A-12C. For example, in FIG. 12A, light source 120 is depicted as having a high tilt angle, and light shield 730 is depicted as being in a lowered position, wherein said lowered position prevents an amount of light from escaping into an area of luminaire 100 above the upper surface 220 of support panel 140. Moving to FIG. 12B, light source 120 is depicted as having an intermediate tilt angle, and light shield 730 is depicted in a partially raised position. Following on to FIG. 12C, light shield 730 is depicted in a fully raised position (low tilt angle) as light source 120 is depicted in a fully upright position.

It is noted that aiming system 110 may adjust a tilt angle of light source 120 from an angle of approximately 0° to an angle of approximately 60°. Furthermore, a tilt angle of aiming system 110 may be adjusted by a screw drive 1110, wherein said screw drive 1110 is configured to allow the tilt angle to be infinitely adjusted (to any angle) between a first angle (which may be approximately 0°) to a second angle (which may be approximately 60° or more). Furthermore, rotation mechanism 510 may be configured to allow a rotation angle of aiming system 110, such as rotation angle 610, to be infinitely adjustable between a first angle of rotation, which may be 0°, and a second angle of rotation, which may be 370° or more.

Figure 13B:
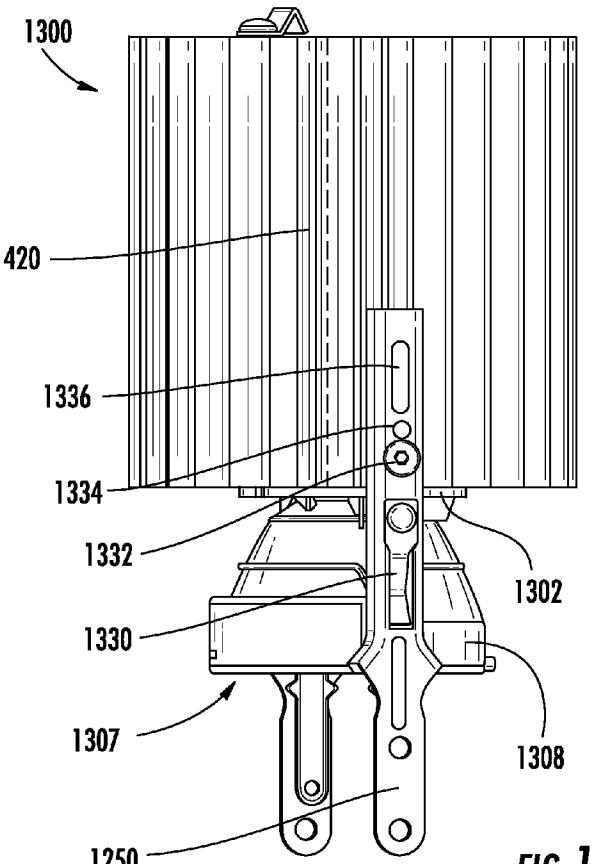
FIGS. 13A and 13B illustrate isometric views of an assembly of luminaire.
Figure 13A:
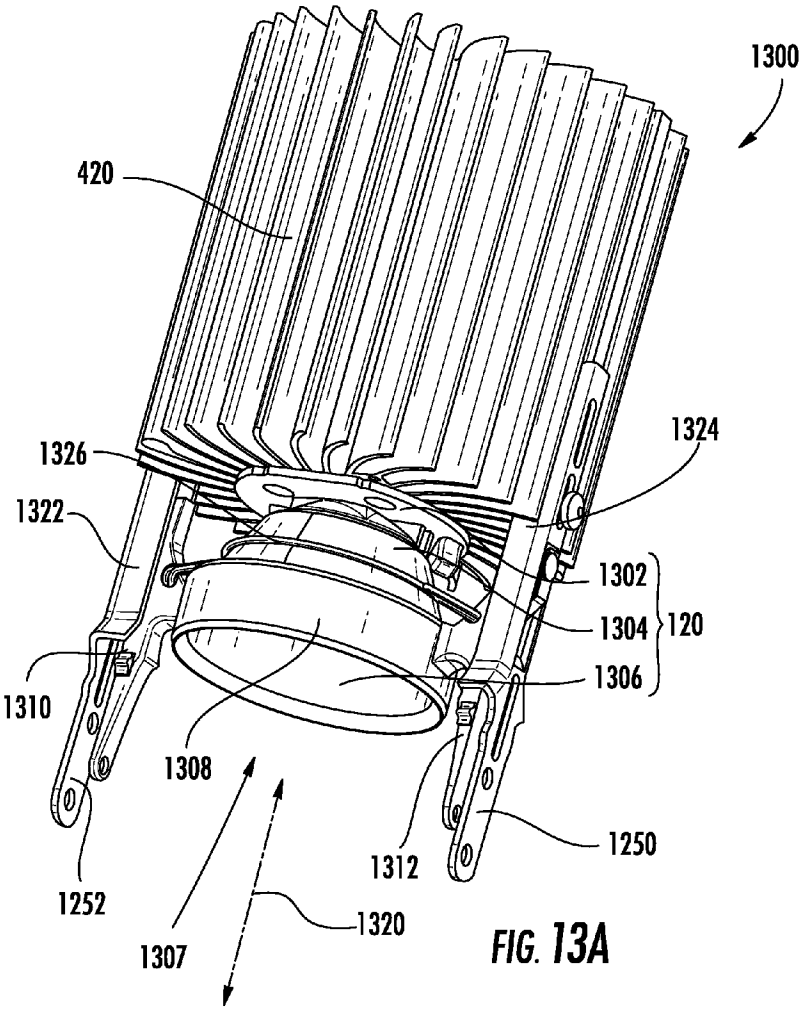

FIGS. 13A and 13B depict an assembly of luminaire 100. In particular, FIG. 13A heatsink 420 coupled to a first light source support structure 1250 and a second light source support structure 1252. Further, an electronic element 1302 may be coupled to heatsink 420, wherein electronic element 1302 may comprise one or more light-emitting elements. In one specific example, electronic element 1302 may comprise one or more LED circuits. Those of ordinary skill in the art will understand that electronic element 1302 may comprise any known light source including, among others, an incandescent bulb or a halogen lamp, among others. As such, electronic element 1302 may be rigidly coupled to heatsink 420 such that heat energy may be conducted between element 1302 and heatsink 420.

In one example, assembly 1300 comprises an optic cartridge 1307 removably coupled to the first light source support structure 1250 and the second light source support structure 1252. In particular, optic cartridge 1307 may comprise an optic cartridge sleeve 1308, a first optic cartridge arm 1310, and a second optic cartridge arm 1312, and wherein optic cartridge 1307 may be removably coupled to elements 1250 and 1252 by sliding the first optic cartridge arm 1310 into a first support structure keyway 1322 and the second optic cartridge arm 1312 into a second support structure keyway 1324. Accordingly, in one example, optic cartridge 1307 may be removably coupled to elements 1250 and 1252 by sliding in/out along a direction indicated by arrow 1320, and the like.

In one example, assembly 1300 comprises light source 120, wherein light source 120 further comprises electronic element 1302, optic 1304 (otherwise referred to as optic reflector, or reflector), and/or diffusing filter 1306 (otherwise referred to as a lens).

FIG. 13B depicts an alternative view of assembly 1300. In one example, FIG. 13B depicts optic cartridge 1307 removably coupled to the first light source support structure 1250. Accordingly, light source support structure 1250 further comprises a leaf spring 1330, the fastener 1332, a fastener hole 1334, and a fastener slot 1336. In one example, fastener 1332 may comprise any fastening means known to those ordinary skill in the art, including, among others, a screw, rivet, a pin, or a tab, among others. In one example, fastener 1332 may be utilized to rigidly coupled the first light source support structure 1250 to heatsink 420. Accordingly, in one example, fastener 1332 may be removed, and the first light source support structure 1250 may be adjusted such that fastener 1332 is received into fastener hole 1334 or fastener slot 1336. In this way, by adjusting the first light source support structure 1250, a distance between diffusing filter 1306 and electronic element 1302 may be adjusted to accommodate varying light source types, and/or varying optic (1304) shapes and/or sizes. Accordingly, it will be readily understood to those of ordinary skill in the art class a similar configuration of a fastener, such as fastener 1332, and elements 1334 and 1336 may be present on the second light source support structure 1252, and the like.

In one example, leaf spring 1330 may be utilized to removably couple optic cartridge 1307 (and in particular, optic 1304) to electronic element 1302. Accordingly, leaf spring 1330 may engage with the second optic cartridge arm 1312 to urge said arm towards electronic element 1302 using a spring force. It will be readily understood to those of ordinary skill in the art that the second light source support structure 1252 may comprise a similar leaf spring to leaf spring 1330 (not shown).

Figure 14B:
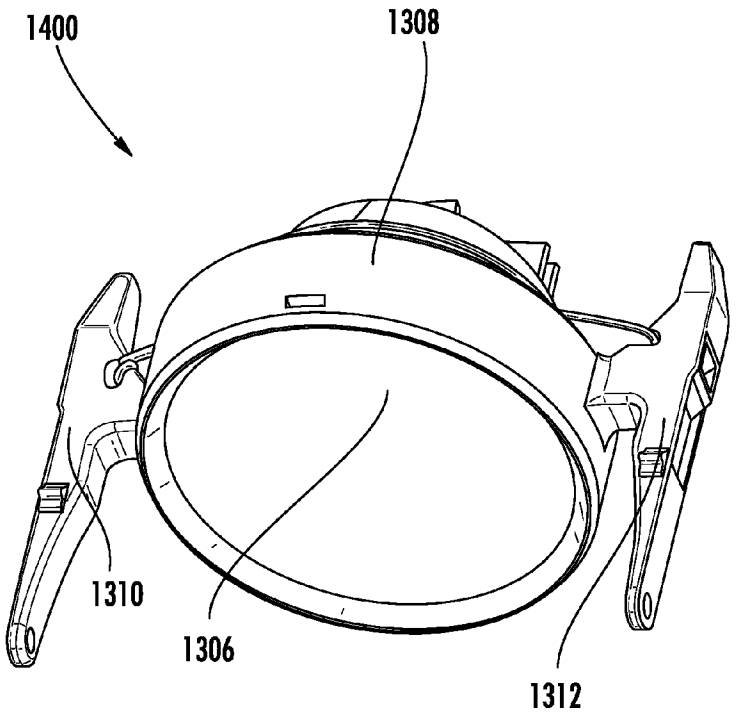
FIGS. 14A and 14B illustrate isometric views of a luminaire assembly comprising an optic cartridge and an optic.
Figure 14A:
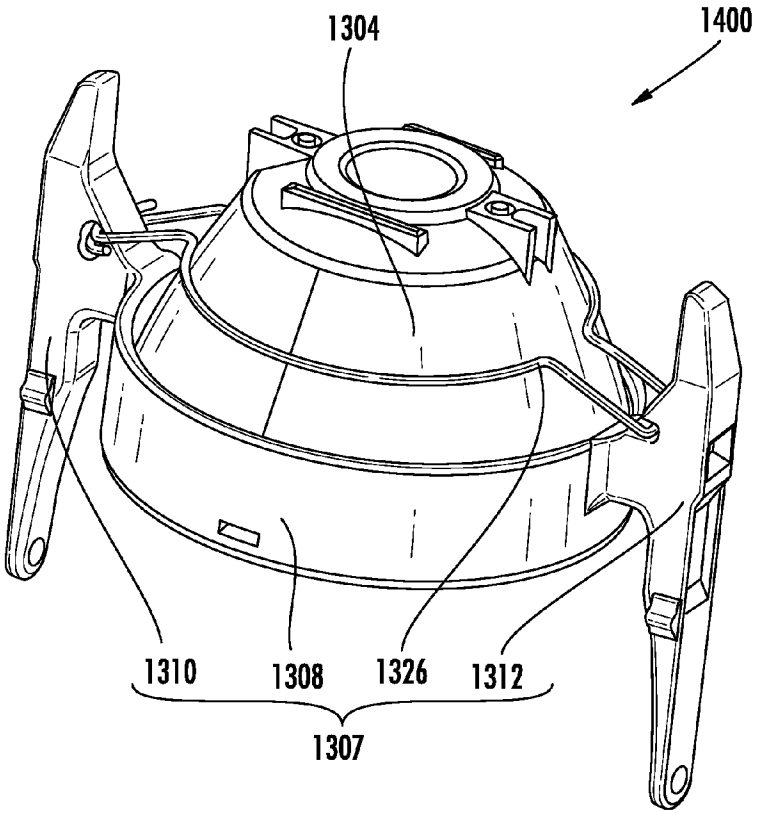

FIGS. 14A and 14B depict a luminaire 100 assembly. In particular, FIG. 14A depicts one view of an assembly 1400 comprising optic cartridge 1307 and optic 1304. In one example, assembly 1400 may be configured to be removably coupled to assembly 1300 from FIG. 13. As such, assembly 1400 may be configured to be inserted/removed from assembly 1300 along that direction indicated by arrow 1320 from FIG. 13A. In one example, optic cartridge 1307 comprises a first optic cartridge arm 1310, and optic cartridge sleeve 1308, a second optic cartridge arm 1312, and a retention spring 1326. In one example, retention spring 1326 may be configured to retain optic 1304 within optic cartridge 1307 by exerting a spring force on optic 1304 to urge said optic into contact with optic cartridge sleeve 1308, and the like.

In one example, as depicted in FIG. 14A, optic 1304 may be removably coupled to a diffusing filter 1306. As such, diffusing filter 1306 may comprise any material configured to diffuse visible light. Accordingly, diffusing filter 1306 may comprise a polymer, a glass, or any other material configured to be partially or wholly transparent to visible light. In another embodiment, element 1306 may be referred to as a lens, and configured to focus and/or adjust light emitted from electronic element 1302.

In one example, optic 1304 and diffusing filter 1306 may be configured to be removably coupled to optic cartridge 1307. Accordingly, optic 1304 and diffusing filter 1306 may be removed from optic cartridge 1307 by pivoting retention spring 1326 to an open position (not shown) from that closed position depicted in FIG. 14A. In one example, optic 1304 and diffusing filter 1306 are depicted removed from optic cartridge 1307 in FIG. 15.

Figure 15B:
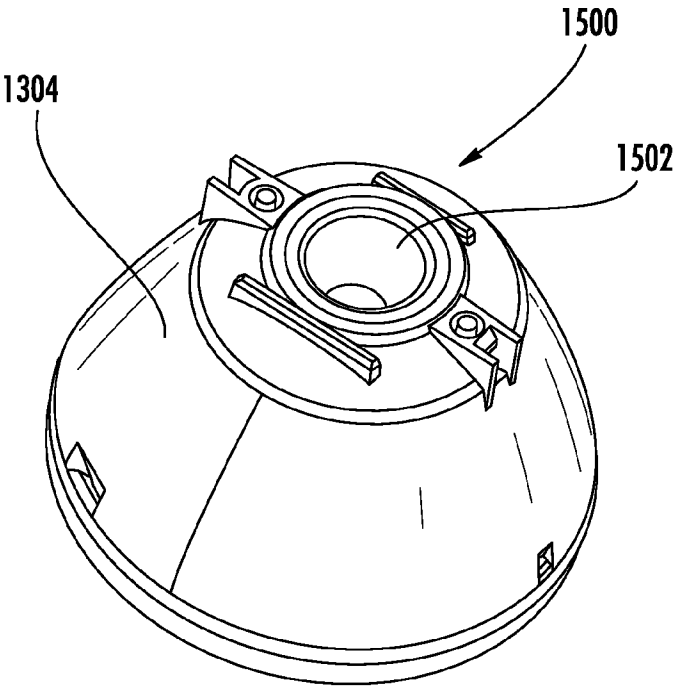
FIGS. 15A and 15B illustrate isometric views of an optic assembly 1500 with an optic and a diffusing filter.
Figure 15A:
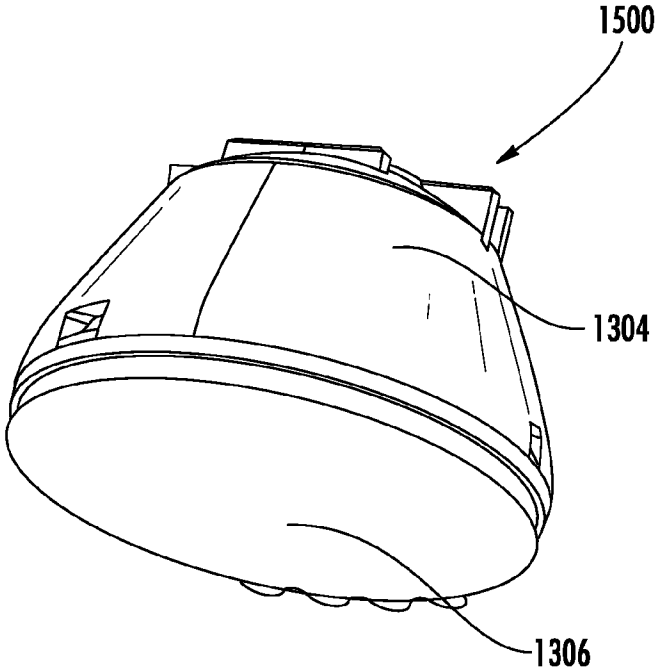

FIGS. 15A and 15B depict an optic assembly 1500. In particular, FIG. 15A depicts optic 1304 and diffusing filter 1306. In one example, as depicted in FIG. 15B, optic 1304 comprises an opening 1502, wherein opening 1502 may be utilized to allow light to enter from electronic element 1302. In one example, optic 1304 may have a reflective inner surface (not shown) such that light entering through opening 1502 is reflected out through diffusing filter 1306.

Figure 16B:
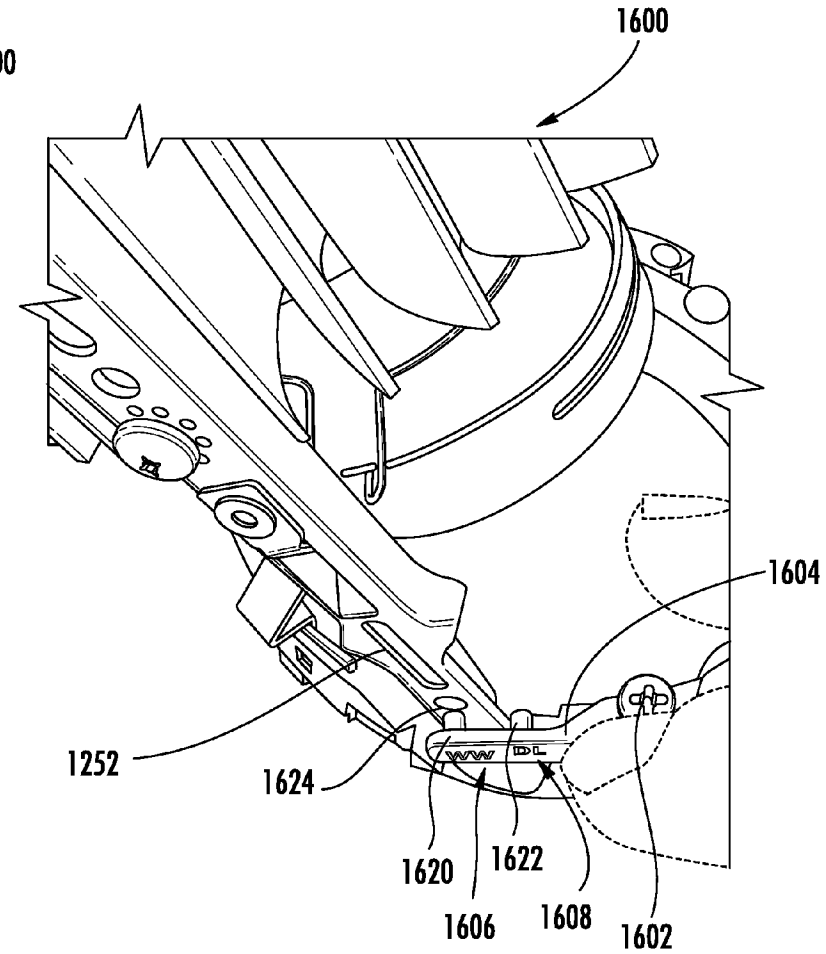
FIGS. 16A-16D illustrate isometric views of another embodiment of a luminaire.
Figure 16A:
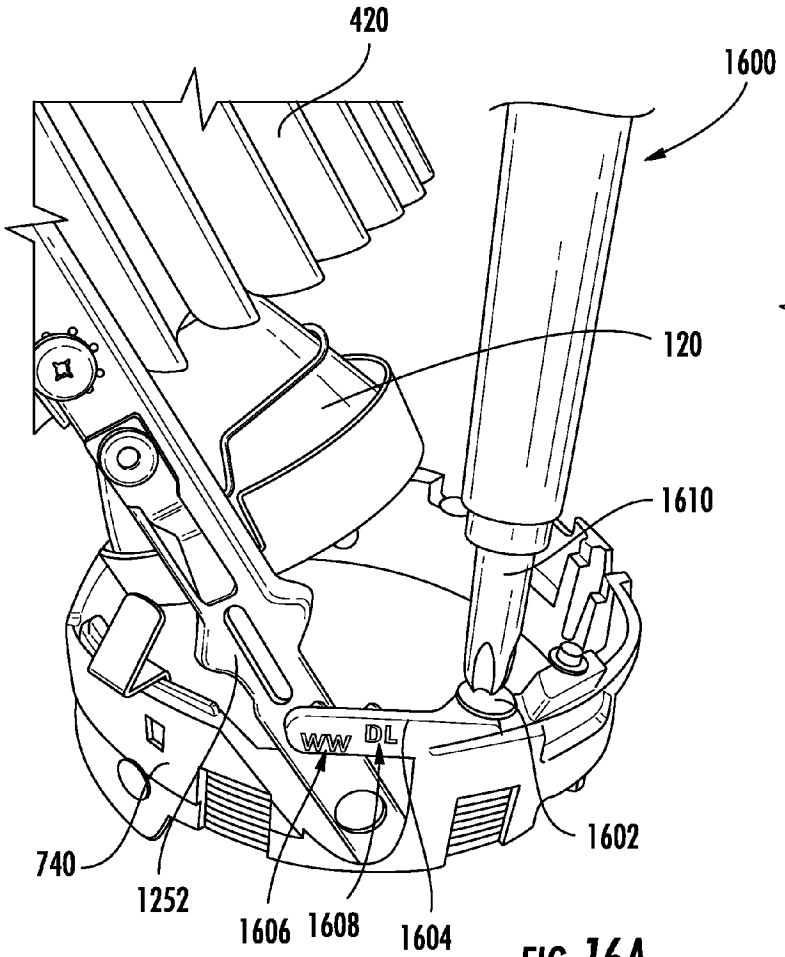

FIGS. 16A and 16B depict a luminaire assembly configured to adjust a tilt angle of a light source from a wall-wash position to a downlight position. In particular, FIG. 16A depicts an assembly 1600 comprising the rotation mechanism sleeve 740, heatsink 420, light source 120, and second light source support structure 1252. Further, assembly 1600 comprises an angle adjustment arm 1604 configured to adjust a tilt angle of light source 120 from a wall-wash position to a downright position, wherein the wall-wash position is indicated by label 1606, and the downright position is indicated by label 1608. Accordingly, in one example, a tilt angle of light source 120 is set by coupling the second light source support structure 1252 to the rotation mechanism sleeve 740 with the angle adjustment arm 1604. As such, a tilt angle of light source 120 from assembly 1600 may be adjusted without using a tilt linkage, such as tilt linkage 430.

In one example, angle adjustment arm 1604 is adjusted from a wall-wash position to a downright position by actuation of fastener 1602. In one example, fastener 1602 is configured to be actuated with a screwdriver 1610, however those of ordinary skill in the art will understand that fastener 1602 may comprise any known means for fastening including, among others, a bolt, a thumb screw, or a rivet, among others. In one example, assembly 1600 from FIG. 16A is configured with light source 120 at a wall-wash angle, as indicated by wall-wash label 1606 aligning with the second light source support structure 1252.

FIG. 16B depicts assembly 1600 being adjusted from a wall-wash position to a downright position. In particular, FIG. 16B depicts angle adjustment arm 1604 having a first tab 1620 and a second tab 1622. Furthermore, the second light source support structure 1252 is configured with a coupling hole 1624 configured to receive one of the first tab 1620 or the second tab 1622. Those ordinary skill in the art will understand that angle adjustment arm 1604 may alternatively comprise a single tab, or multiple tabs in excess of those two tabs 1620 and 1622 depicted in FIG. 16B, without departing from this disclosure.

In one example, a tilt angle of light source 120 is adjusted from a wall-wash angle to a downlight angle by pivoting angle adjustment arm 1604 about fastener 1602 to remove the first tab 1620 from the coupling hole 1624 (and as indicated FIG. 16B). Accordingly, it will be readily apparent to those of ordinary skill in the art that a wall-wash angle (indicated by an alignment of label 1606 with support structure 1252) or a downlight angle (indicated by alignment of label 1608 with support structure 1252) may align light source 120 at any tilt angle. For example, a wall-wash angle may correspond to a tilt angle 450 of approximately 40°-50°. Furthermore, a down light angle may correspond to a tilt angle 450 of approximately 5°, or less than 10°, and the like.

Figure 16D:
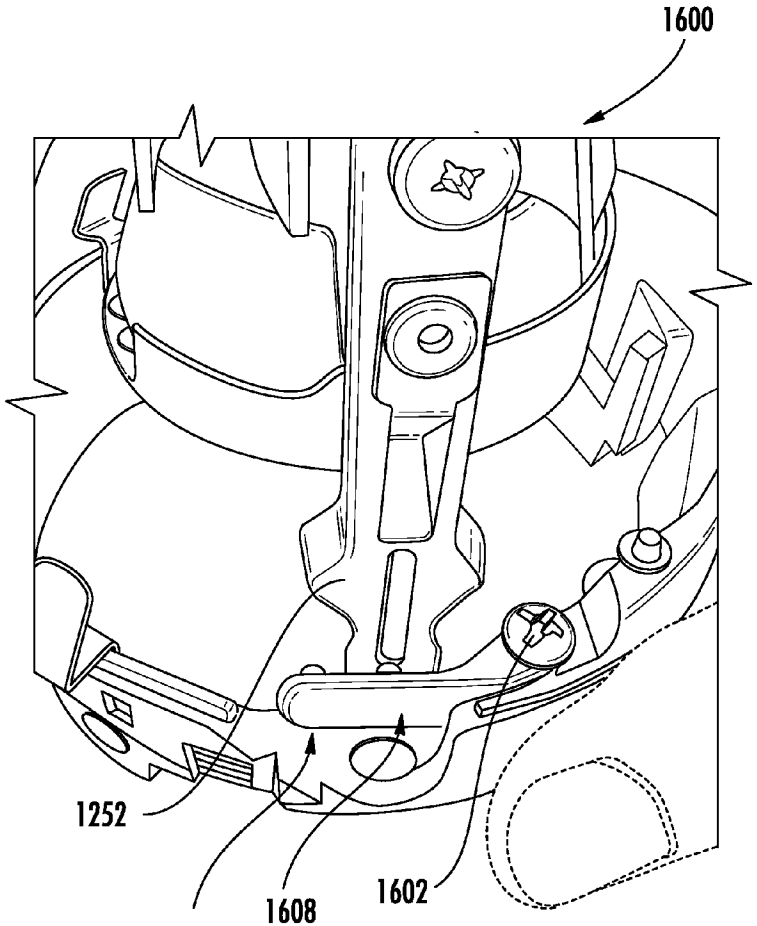
Figure 16C:
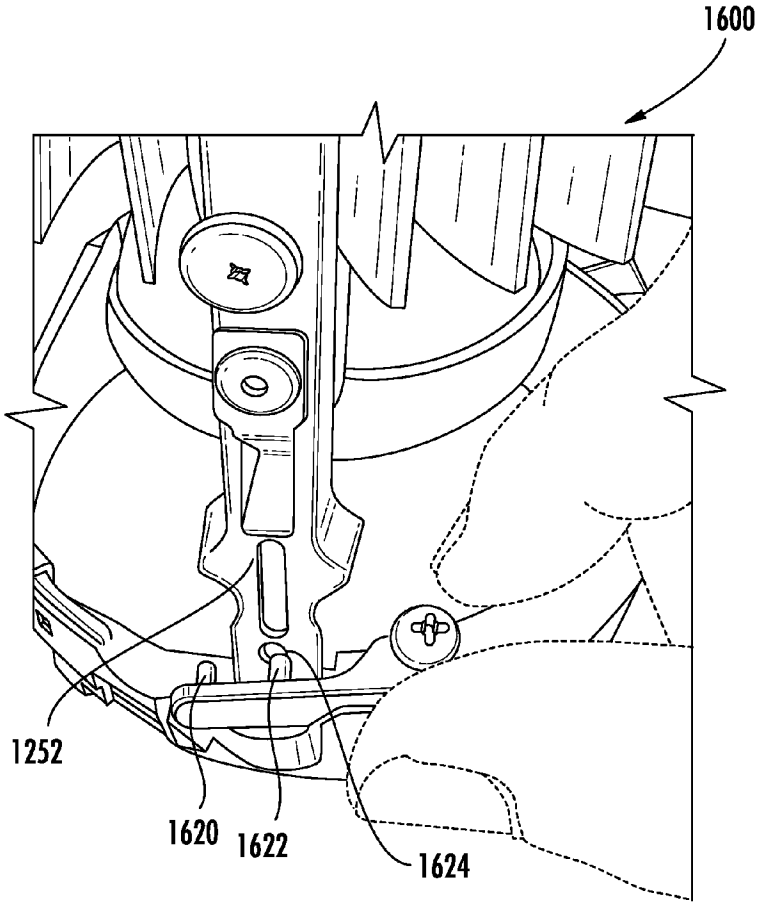

FIG. 16C depicts assembly 1600 adjusted to a downlight tilt angle, as indicated by alignment of the second tab 1622 with the coupling hole 1624. Accordingly, upon receiving the second 1622 into the coupling hole 1624 (as indicated in FIG. 16D), fastener 1602 may be tightened to lock support structure 1252 into the depicted downlight position.

[79] The present invention has been described in terms of preferred and exemplary embodiments thereof. Numerous other embodiments, modifications and variations within the scope and spirit of the appended claims will occur to persons of ordinary skill in the art from a review of this disclosure.

We claim:

1. A luminaire for use with a light source, comprising:

a support panel;

an aiming system removably coupled to the support panel, and configured to receive and orient the light source, the aiming system further comprising:

a rotation mechanism configured to adjust a rotational orientation of the aiming system about an axis of rotation with respect to the support panel;

a tilt linkage, configured to adjust an angular orientation of the aiming system, the tilt linkage having:

a light source support structure, rigidly coupled to the light source at a first end, and pivotally coupled to a rotation mechanism sleeve at a second end;

a linear actuator, rigidly coupled to the rotation mechanism sleeve at a first end, having a carrier structure for translating along a length of the linear actuator in a direction parallel to the axis of rotation, and having a spring mechanism configured to compress between the rotation mechanism sleeve and the carrier structure such that the spring mechanism reduces an amount of backlash upon actuation of the linear actuator; and a bracket structure, pivotally coupled to the carrier structure at a first end, and pivotally coupled to the light source support structure at a second end, wherein the coupling at the second end of the bracket structure is between the first and second ends of the light source support structure, and wherein the bracket structure is configured to convert a linear motion of the carrier structure into a rotational motion of the light source support structure about the pivotal coupling at the second end of the light source support structure.

2. The luminaire of claim 1, wherein the rotational and angular orientation of the light source is adjustable while the light source is on.

3. The luminaire of claim 1, further comprising:

an internal light shield coupled to the bracket structure, wherein the internal light shield is configured to move as a tilt angle of the light source support structure is adjusted.

4. The luminaire of claim 1, wherein an angle of tilt of the aiming system is infinitely adjustable between a first tilt angle and a second tilt angle.

5. The luminaire of claim 4, wherein the first tilt angle is approximately 0 degrees and the second tilt angle is approximately 50 degrees with respect to a normal to a surface of the support panel.

6. The luminaire of claim 1, wherein the rotation mechanism is configured to be infinitely adjustable between a first rotation angle and a second rotation angle.

7. The luminaire of claim 6, wherein the first rotational angle is approximately 0 degrees and the second rotation angle is greater than approximately 360 degrees.

8. The luminaire of claim 1, wherein the spring mechanism comprises a coil spring, wherein compression of the coil spring is further configured to exert a spring force to counterbalance a weight of the aiming system as the linear actuator increases a tilt angle of the light source.

9. The luminaire of claim 1, further comprising:

a trim assembly, the trim assembly having a trim plate, and coupled to the rotation mechanism by a leaf spring key on the trim assembly that is received into a corresponding keyway on the rotation mechanism.

10. The luminaire of claim 9, wherein the trim assembly is coupled to the rotation mechanism by a safety wire.

11. The luminaire of claim 10, wherein the safety wire is further configured to maintain a correct orientation and alignment of the trim assembly relative to the rotation mechanism.

12. A recessed luminaire, comprising:

a support panel;

an aiming system, removably coupled to the support panel, and configured to receive and orient a light source, the aiming system further comprising:

a rotation mechanism, configured to rotate the aiming system about an axis of rotation to adjust a rotational orientation of the aiming system with respect to the support panel;

a tilt linkage, configured to adjust an angular orientation of the aiming system, the tilt linkage having:

a light source support structure, rigidly coupled to the light source at a first end, and pivotally coupled to a rotation mechanism sleeve at a second end;

a linear actuator, rigidly coupled to the rotation mechanism sleeve at a first end, having a carrier structure for translating along a length of the linear actuator in a direction parallel to the axis of rotation;

a bracket structure, pivotally coupled to the carrier structure at a first end, and pivotally coupled to the light source support structure at a second end, wherein the coupling at the second end of the bracket structure is between the first and second ends of the light source support structure, and wherein the bracket structure is configured to convert a linear motion of the carrier structure into a rotational motion of the light source support structure about the pivotal coupling at the second end of the light source support structure, thereby adjusting a tilt angle of the light source; and an internal light shield coupled to the bracket structure, wherein a position of the internal light shield is configured to adjust as the tilt angle of the light source is adjusted.

13. The recessed luminaire of claim 12, wherein the internal light shield is configured to move into a lowered position as the linear actuator is actuated to increase a tilt angle of the light source.

14. The recessed luminaire of claim 12, wherein the light shield is configured to obscure one or more elements of the luminaire.

15. The recessed luminaire of claim 12, wherein the support panel further comprises a tab stop configured to contact a rotation tab on the rotation mechanism sleeve such that the rotation mechanism sleeve cannot be rotated through an angle greater than approximately 360 degrees.

16. The recessed luminaire of claim 12, wherein the aiming system is configured to removably couple to an optic cartridge.

17. The recessed luminaire of claim 16, wherein the optic cartridge is removably coupled to the light source support structure by a leaf spring in a keyway.

18. The recessed luminaire of claim 16, wherein the optic cartridge is removably coupled to a reflector and a diffusing filter.

19. The recessed luminaire of claim 12, wherein the support panel is configured to couple to a ceiling structure.

20. The recessed luminaire of claim 12, wherein the aiming system is positioned above an upper surface of the support panel.

21. The recessed luminaire of claim 12, wherein the aiming system includes a lower portion accessible through an aperture in the support panel, the lower portion providing access to a rotational member and a tilt member such that one or more of the angular orientation and the rotational orientation of the light source may be adjusted while the light source is in operation.

22. A recessed luminaire, comprising:

a support panel;

an aiming system removably coupled to the support panel, and configured to receive and orient a light source, the aiming system further comprising:

a rotation mechanism configured to rotate the aiming system about an axis of rotation with respect to the support panel, the rotation mechanism further comprising:

a rotation mechanism sleeve, configured to rotatably couple to the support panel at an opening, wherein the rotation mechanism sleeve comprises one or more tab structures configured to contact, and rotate relative to a lower surface of the support panel, and one or more rotation spring mechanisms configured contact, and rotate relative to an upper surface of the support panel; and a tilt linkage, rigidly coupled to the light source at a first end, and pivotally coupled to a rotation mechanism sleeve at a second end, said tilt linkage configured to adjust an angular orientation of the aiming system.

23. The recessed luminaire of claim 22, wherein the one or more rotation spring mechanisms are configured with a spring constant to support a weight of the aiming system.

24. The recessed luminaire of claim 22, wherein the one or more rotation spring mechanisms are configured to compress, upon application of a force by a user, to facilitate removal of the aiming system from the support panel.

25. The recessed luminaire of claim 22, wherein the tilt linkage further comprises:

an angle adjustment arm, configured to be adjusted between a downlight position and a wall-wash position, wherein the downlight position angles the light source at a first tilt angle, and the wall-wash position angles the light source at a second tilt angle.

26. The recessed luminaire of claim 25, wherein the first tilt angle is a tilt angle of less than 10°, and the second tilt angle corresponds to a tilt angle of approximately 25°-45°.

* * * * *